United States Patent [19]

Firey

[11] 4,205,647

[45] Jun. 3, 1980

[54] ENGINE INTAKE FUEL FRACTIONATOR AND STRATIFIER

[76] Inventor: Joseph C. Firey, P.O. Box 254 Northgate, Seattle, Wash. 98125

[21] Appl. No.: 974,343

[22] Filed: Dec. 29, 1978

[51] Int. Cl.[2] ..... F02M 31/00; F02M 17/18

[52] U.S. Cl. ..... 123/133; 123/122 D; 261/89; 48/180 S

[58] Field of Search ..... 123/122 D, 133, 127, 123/190 A, 190 R; 48/180 S; 261/89

[56] References Cited

U.S. PATENT DOCUMENTS

| | | | |
|---|---|---|---|
| 1,061,995 | 5/1913 | Erickson | 261/89 |
| 1,190,540 | 7/1916 | Gehelman | 261/89 |
| 1,625,281 | 4/1927 | Rague | 48/180 S |
| 2,447,423 | 8/1940 | Nies | 123/190 A |
| 3,667,436 | 6/1972 | Reichheln | 123/133 |
| 3,788,292 | 1/1974 | Lee, Jr. | 123/133 |
| 3,886,919 | 6/1975 | Freeman | 123/133 |

FOREIGN PATENT DOCUMENTS

| | | | |
|---|---|---|---|
| 581442 | 11/1924 | France | 261/89 |

*Primary Examiner*—Ronald H. Lazarus

[57] ABSTRACT

A single multicomponent internal combustion engine fuel is fractionated by evaporation and mixed with air to form a wide variety of air fuel mixtures within the vaporizer portion. These several kinds of air fuel vapor mixtures differ among themselves as to the kinds of fuel molecules present and as to the ratio of air to fuel vapor. A stratifier valve serves to create a multiregional stratified air fuel mixture at engine intake by drawing differing regions from amongst these many kinds made available within the vaporizer.

42 Claims, 1 Drawing Figure

ENGINE INTAKE FUEL FRACTIONATOR AND STRATIFIER

CROSS REFERENCES TO RELATED APPLICATIONS

In U.S. Patent application, Ser. No. 740481, Joseph C. Firey inventor, entitled "Engine Intake Stratifier," the several beneficial objects made available by use of multiregional stratified intake mixtures for internal combustion engines are described together with descriptions of particular apparatus to achieve multiregional stratified intake mixtures for internal combustion engines.

BACKGROUND OF THE INVENTION

1. Field of the Invention

The field of this invention is internal combustion engines and particularly such engines utilizing multiregional stratified air-fuel mixtures at the engine intake manifold and intake valve. Both spark ignition and compression ignition internal combustion engines are included.

2. Description of the Prior Art

Many spark ignition engines of the prior art have utilized stratified air-fuel mixtures at the engine intake manifold and/or intake valve (see for example references A, B, C, D, E, F, BB, CC, DD). In these prior art, spark ignition, stratified mixture, engines, two kinds of air-fuel mixtures are utilized differing in the ratio of air to fuel, and any one kind of air-fuel mixture is contained within a single continuous region and is not broken up into several small regions separated from one another by regions of another kind. As a result, whenever any portion of such a single continuous region is ignited by a spark, or any other ignition means, the entire region burns fully within a short time interval thereafter. This latter circumstance means compression ignition is impractical to use as a means of igniting these continuous regions, since compression ignition completes the burning of the entire region extremely quickly and strong pressure waves and an extremely loud engine noise are the consequence. Hence these prior art stratified mixture spark ignition engines can only use a spark or a flame from a spark for the ignition of the air-fuel mixture within the engine cylinder. As a result only those air-fuel mixtures which are spark ignitable or flame ignitable are used in these prior art stratified mixture engines. This type of engine intake stratification is hereinafter termed "two barrel carburetor stratification" since this is the most common manner of securing this type of stratification. In some cases of the prior art, in addition to one or two continuous air-fuel mixture zones as described above, an additional, continuous, air-only zone is also included in the stratified intake mixture. The term "two barrel carburetor stratification" is intended hereinafter to also include this type of intake stratification.

Experiments in engines show that air-fuel mixtures leaner in fuel than 24 lbs. of air per lb. of fuel cannot be spark ignited (see for example reference G) and that air-fuel mixtures leaner in fuel than about 27 lbs. of air per lb. of fuel cannot be flame ignited (see for example reference H). These then are the leanest mixtures useable in prior art, stratified mixture, spark ignition engines.

The use of very lean mixtures is desired in order to reduce the undesireable exhaust emissions of oxides of nitrogen. Experiments in engines show these emissions to decrease as air-fuel mixtures leaner in fuel are supplied to the engine (see for example references I and J). For prior art, stratified mixture, spark ignition engines, this beneficial effect of leaner mixtures to reduce oxides of nitrogen can only be utilized up to the flame or spark ignition limit of mixture ratio described above.

Extremely lean mixtures, at least as lean as 45 lbs. of air per lb. of fuel, can readily be compression ignited (see for example references K and L) and in this way greater reductions of exhaust emissions of oxides of nitrogen can be achieved than is possible with prior art, stratified mixture, spark ignition engines. When, however, compression ignition is used with air-fuel mixtures premixed according to the prior art in the engine intake manifold, strong pressure waves and in consequence unacceptably loud engine noise are produced (see for example reference M).

The diesel engine has long used compression ignition, and of very lean overall air-fuel ratio, without creating excess engine noise. Admittedley a diesel engine is commonly somewhat noisier than a spark ignition engine but is nowhere near as noisy as a prior art spark ignition engine in which a large continuous portion of the mixture is being compression ignited. The reason why the diesel engine can use compression ignition without excess noise must be sought in the manner of creating the air-fuel mixture which is then compression ignited.

In the diesel engine the air-fuel mixture is not created in the intake manifold but rather by injecting the liquid fuel into the already compressed air in the cylinder only a short time before ignition. As a result the air-fuel mixture which is compression ignited is stratified, in a particular way, since there is not enough time between injection and compression ignition for this liquid fuel to first evaporate and then diffuse fully into the surrounding air mass. The particular kind of stratification obtained in a diesel engine is hereinafter referred to as "injected liquid spray" type of stratification of an air-fuel mixture. This injected liquid spray kind of stratification is obtained when a liquid fuel is injected under high pressure into an air mass and atomized into many separate liquid drops. Fuel evaporates from each drop and diffuses gradually into the surrounding air and thus creates a zone of air-fuel mixture around each drop. Within each such zone a wide range of air-fuel ratios exists varying continuously all the way from very fuel rich next to the liquid surface of the drop, to very fuel lean fartherest away from the drop surface. The total number of fuel containing zones created is essentially equal to the number of liquid drops created by atomization. These many fuel containing zones are separate, discontinuous and essentially alike in having a wide range of air-fuel mixture ratios. In addition, one or more air-only zones may be created in those parts of the air mass into which no liquid fuel was injected. These evaporation and diffusion processes which create the injected liquid spray type of stratification are described in references N. O and P. An example of the use of this injected liquid spray type of stratification in the intake manifold of a spark ignition engine, rather than in the combustion chamber, is presented in reference EE.

An air-fuel vapor mixture can be ignited by compressing it adequately within a piston and cylinder chamber. Ignition does not occur immediately upon compression but only after a compression ignition time delay interval whose length varies with the degree of compression, the air-fuel ratio of the mixture, and the type of fuel in the mixture (see for example reference Q). In contrast to spark ignition, compression can be used to ignite air-fuel vapor mixtures of almost any air-fuel ratio provided only that adequate compression is applied. Hence extremely lean air-fuel mixtures can be compression ignited which could not be spark ignited. The burning process which occurs after an air-fuel mixture is compression ignited occurs with extreme rapidity as shown in reference R. The mechanism of this extremely rapid burning is a subject of controversy at this time but, if it does take place via the travel of a burning zone through the air-fuel mixture, then there is general agreement that the velocity of travel of this burning zone must be of the order or several thousands of feet per second, a velocity roughly ten times faster than that of the normal spark ignited flame. This extemely rapid burning and energy release from compression ignition creates strong gas pressure waves in the cylinder (see for example reference S) and, in consequence a very loud engine noise.

The diesel engine uses only compression ignition of an air-fuel mixture created by the injected liquid spray technique as described heretofore. The strong pressure waves, characteristic of compression ignition, are generated separately in each ignition region around each fuel droplet and, not being coordinated between regions, these several individual pressure waves occur at different times and travel in different directions and do not act together to increase engine noise. A consequence of this time and position dispersed occurence of compression ignition in the diesel engine is that this engine is much quieter running than is a compression ignition engine utilizing two barrel carburetor type of stratification at intake or homogeneous, premixed air-fuel mixtures. These latter engines are so noisy as to be unsuitable for any ordinary engine application. Hence we see that the combustion noise of compression ignition can be reduced to acceptable levels by having the compression ignition processes occur separately in individually small volume regions and at different times between regions.

In a diesel engine, after compression ignition has occurred the unevaporated liquid fuel portions and the over-rich-in-fuel portions, present in each region of the stratified air-fuel mixture, burn only with difficulty and some of these portions become soot which survives to exhaust in the form of exhaust smoke, an undesirable exhaust emmission of the diesel engine. The effects of fuel evaporating ability upon exhaust smoke emmissions of diesel engines is described in reference AA.

The most common type of spark ignition engine in use today, the gasoline engine, uses spark ignition in combination with a single barrel or two barrel carburetor for creating the air-fuel mixture. The resulting air-fuel mixture must be within the spark ignitability limits and in consequence engine torque is controlled by throttling the engine intake mixture. The result is a loss of engine efficiency due to the necessity of pumping out the exhaust gases at full atmospheric pressure. The magnitude and deleterious effects of this pumping loss are described in reference U. The normal flame, started by spark ignition, cannot reach all the way to the chilled surfaces of the combustion chamber and the thin film of air-fuel mixture next to the surfaces of the combustion chamber fails to burn fully and emerges as unburned hydrocarbon emmissions in the engine exhaust. Although these undesirable emmissions can be reduced by leaning out the air-fuel ratio, only limited improvements are available within the spark ignition inflammability limits. These surface film effects on hydrocarbon emissions are described in reference T and the effects thereon of air-fuel ratio are discussed in reference V. When the compression ratio of a gasoline engine is increased, in order to increase the efficiency of the engine, compression ignition of the last burning portions of the homogeneous air-fuel mixture may occur and the consequent locally rapid rate of pressure rise causes the undesirable noise known as knock. Although knock can be prevented by increasing the octane rating of the fuel being used such higher octane fuels are more difficult to prepare and thus are most costly to use. The compression ignition process of gasoline engine knock occurs in a single, moderate sized, region of essentially uniform and homogeneous air-fuel mixture and hence the pressure wave, characteristic of compression ignition, is a single, strong pressure wave which greatly increases engine noise.

In a spark ignition engine, whose air-fuel mixture is stratified at the time of combustion by containing some air-only regions or by containing some regions too lean for spark ignition, special ignition arrangements are sometimes needed to assure that spark ignition of the spark ignitable air-fuel mixture regions will take place at the proper time in the engine cycle. Various kinds of arrangements have been used in the prior art for this purpose including:

(1) Locating the spark plug in the combustion chamber at a place where a spark ignitable region of the stratified air-fuel mixture is also located.
(2) Using a long duration spark discharge when the stratified air-fuel mixture is moving.
(3) Using two or more spark plugs (multiple spark plugs) located at different places in the combustion chamber.

To assure spark ignition of the spark ignitable regions requires only that a spark be present in the plug gap with the spark ignitable region also at the plug. In this way spark ignition of the spark ignitable regions can be secured by using one or a combination of the foregoing arrangements as is well known in the art.

That an air-fuel mixture, stratified in the engine intake manifold, will retain this stratification throughout the intake and compression processes, and thus be stratified at the time of combustion, has been shown in the "Background of the Invention" portions of the cross referenced related application and the references X, Y, Z as discussed therein.

In summary, the foregoing description of that portion of the internal combustion engine prior art, relevant to stratified intake mixtures, shows the following:

(1) Engine exhaust emissions can be reduced by use of leaner air-fuel mixtures.
(2) With spark ignition, air-fuel mixtures leaner than about 24 to 1 or at most 27 to 1 cannot be used as these are not spark ignitable.
(3) With compression ignition air-fuel mixtures at least as lean as 45 to 1 and probably leaner can be used.
(4) Compression ignition of a uniform air-fuel mixture produces excessive engine noise.
(5) The noise of compression ignition can be reduced to acceptable levels by so stratifying the air-fuel mixture that small regions of air-fuel mixture are compression ignited at different times, producing a time and position dispersed occurrence of compression ignition.

(6) Control of spark ignition engine power output by throttling the flow of the intake air-fuel mixture increases the engine friction power loss and hence reduces efficiency.

(7) The spark ignitable portions of a stratified air-fuel mixture can be spark ignited by proper spark plug location, by use of multiple spark plugs, by use of long duration spark discharge or by a combination of these methods.

(8) If the engine air-fuel mixture is stratified in the intake manifold, stratification is retained to the time of combustion.

In the earlier cross referenced application a new kind of intake mixture stratification is described called "multiregional stratification" and is defined therein. The multiregional stratified intake charge of air and fuel, entering the engine cylinder on each intake process, consists of a large number of individual regions of air-fuel mixture. Each of these individual regions is of small volume, the weight ratio of air to fuel is essentially uniform throughout each region and the fuel type is essentially the same throughout each region. Adjacent regions differ in either the type of fuel or the air-fuel ratio or both. A stratified charge of air and fuel satisfying the foregoing requirements is hereinafter and in the claims referred to as a multiregional stratified air-fuel mixture or as an air-fuel mixture possessing multiregional stratification.

Use of such multiregional stratified intake mixtures in internal combustion engines makes available many beneficial objects as described and explained in the earlier cross referenced application. One of the beneficial objects made available by use of multiregional stratified engine intake mixtures is to permit the use of higher compression ratios and the consequent obtaining of higher efficiency from spark ignition engines without excess increase of noise. Higher engine supercharge can also be used to increase the power available from a given size of engine without excess increase of noise. Another beneficial object made available is to increase the part load efficiency of spark ignition engines by reducing the pumping work losses at intake. A further object is to reduce the quantities of undesirable smog generating materials, emitted via the engine exhaust, by making possible very lean mixture operation of the engine and by causing the combustion process to penetrate closer to the combustion chamber surfaces. For compression ignition engines a beneficial object made available is to reduce the quantities of unburned fuel, emitted as smoke, and thus to increase engine efficiency and reduce the emission of undesirable exhaust smoke. A further object is to provide a fueling method for compression ignition engines which is easier to construct and hence of lower cost than the fueling methods presently used for these engines.

One method of achieving certain of the beneficial objects made available by use of multiregional stratified intake mixtures consists in creating differences in the volumetric chemical energy content of the air-fuel mixtures in the various regions and in creating differences in the compression ignition time delay characteristic of the air-fuel mixtures in the various regions. Differences in volumetric chemical energy content can be created by setting different proportions of air to fuel in different regions. Differences in the compression ignition time delay characteristic of the air-fuel mixtures in different regions can be created in various ways already well known in the art such as:

1. Supply a different fuel to each of several different regions, these several fuels differing in the kinds and proportions of hydrocarbons or other fuel components present.
2. Supply a different fuel to each of several different regions, these several fuels differing in the amount or type of anti-knock compound present.
3. Supply a different fuel to each of several different regions, these several fuels differing in the amount or type of proknock compound present.
4. Furnish different proportions of air to fuel in the air-fuel mixtures in different regions.

When subsequently compressed, a multiregional stratified fuel-air mixture can be both spark ignited and compression ignited. Those regions which are compression ignited do so at different times during combustion and the resulting pressure waves are scattered and out of phase with each other. As a result less combustion noise is created than is obtained from the systematic gas vibration obtained when non-stratified air-fuel mixtures are brought to such high compression ratios that compression ignition occurs. Compression ignition of some of the regions produces locally strong pressure waves which, in reflecting off the combustion chamber surfaces, will carry the combustion process closer to the cold surface than is done by the normal spark ignited flame. As a result the thin layer of unburned or incompletely burned air-fuel mixture next to the cold combustion chamber surface, left behind after combustion is complete, is reduced and the smog generating materials originating in this unburned layer are also reduced. To reduce engine power output the number of regions in the multiregional stratified intake air-fuel mixture, which are leaner than chemically correct or which are air only regions can be increased thus reducing the chemical energy available and hence the engine power output. This method of controlling engine power output reduced the pumping work lost in pumping the intake charge into the engine and the exhaust charge out of the engine, when compared to the usual intake manifold throttling method of controlling the power output of spark ignition engines. As is well kown in the art, operation of a spark ignition engine at leaner air-fuel mixtures reduces the quantities of carbon monoxide and, if sufficiently lean, the oxides of nitrogen emitted via the engine exhaust. Hence the unusually lean mixture engine operation made possible by the use of multiregional stratification can reduce the quantities of undesirable carbon monoxide and oxides of nitrogen emitted by an engine. In an engine using compression ignition only, the devices of this invention premix the air and fuel with the fuel being fully evaporated before ignition, and thus less soot will be formed during combustion following ignition than is the case for the usual liquid injection method of supplying fuel to these engines. Liquid injection produces a poorly mixed and incompletely evaporated fuel-air mixture at the time of ignition and incomplete fuel burning results, producing soot and exhaust smoke and a reduction of engine efficiency. These problems of the usual liquid injection method of fuel supply can be largely avoided by use of multiregional stratified engine intake mixtures.

The only known prior art method of creating multiregional stratified intake mixtures for internal combustion engines is that described in the cross referenced related application. The devices of the cross referenced related application create a multiregional stratified air-fuel mixture by connecting a number of separate air-fuel mixing channels individually to a stratifier valve which connects in turn to the engine intake pipe. In each air-fuel mixing channel a particular type of air-fuel mixture is created by an air-fuel mixing device, such as a carburetor, followed by a heated section if needed to evaporate liquid fuel. The different channels produce different types of air-fuel mixture including an air only channel. These air-fuel mixtures may differ in the ratio of air to fuel and in the kind of fuel. The number of air-fuel mixing channels is equal to or greater than the number of different kinds of air-fuel mixture regions desired in the multiregional stratified air-fuel mixture at engine intake. The stratified valve contains at least one fixed port for each of the air-fuel mixing channels. These several fixed ports index with the moving ports of the moving element of the valve in a sequence to produce the desired pattern of differing regions of air-fuel mixture in the multiregional stratified air-fuel mixture passing from the stratifier valve to the engine intake pipe. During the intake process of the engine cylinder air-fuel mixture is drawn into the intake pipe from the moving ports of the moving element of the valve and thus from one set of fixed ports at a time as indexed by the moving ports, in a sequence of such sets of fixed ports repeated with each full cycle of movement of the moving element, and hence from that certain group of fixed ports and their connected air-fuel mixing channels which is composed of all the fixed ports in the several sets of fixed ports indexed by the moving ports. The moving element of the stratifier valve may be shifted relative to the fixed ports so that a different certain group of fixed ports is indexed and in consequence a different pattern of regions is produced in the multiregional stratified air-fuel mixture. Alternatively an adjustable mask may be interposed between the fixed ports and the moving element of the stratifier valve to make available the same capability of changing the pattern of the differing regions in the multiregional stratified air-fuel mixture. The principle, though not the only, reason for changing the pattern of regions is to change the engine power output. By increasing the proportion of leaner mixture regions or air only regions the power output of the engine may be decreased.

One disadvantage of the schemes used in the cross referenced related application to create the multiregional stratified engine intake mixture is that the stratifier valve is mechanically complex since engine torque is changed by changing the stratifier valve so as to index a different sequence of fixed ports within the valve.

Another disadvantage of the schemes used in the cross referenced related application to create the multiregional stratified engine intake mixture is that two or more different fuels are preferably used when a wide range of compression ignition time delay intervals is desired in order to reduce engine noise. Hence two or more fuel tanks and supply systems are then needed which increase the cost and complexity of the engine system. Additionally the use of two or more fuel tanks creates awkward refueling problems during engine use as, for example, when only one fuel tank has emptied.

The apparatus of this invention is used, in combination with an internal combustion engine, as a replacement for the torque control and air-fuel mixing equipment of said internal combustion engine and is connected to the intake port of said engine as described hereinafter, The term "internal combustion engine" is used hereinafter and in the claims to mean the known combinations comprising cylinders, cylinder heads, pistons operative within said cylinders and connected to a crankshaft via connecting rods, valves and valve actuating means or cylinder ports, lubrication system, cooling system, ignition system if needed, flywheels, starting system, fuel supply system, fuel-air mixing system, intake pipes and exhaust pipes, torque control system, etc. as necessary for the proper operation of said internal combustion engine. The term "internal combustion engine" is used hereinafter and in the claims to include also the known combinations as described above but wherein the cylinders, cylinder heads, pistons operative within said cylinders and connected to a crankshaft via connecting rods, valves an valve actuating means or cylinder ports, are replaced by a rotary engine mechanism combination, comprising a housing with a cavity therein, and plates to enclose the cavity, a rotor operative within said cavity and sealing off separate compartments within said cavity and connecting directly or by gears to an output shaft, ports in said housing for intake and exhaust. The term "internal combustion engine" as used herein includes atmospherically aspirated internal combustion engines as well as supercharged internal combustion engines using turbochargers or other types of intake air compressors.

References:

A. Goosak et al, U.S. Pat. No. 3,283,751
B. Mallory, U.S. Pat. No. 2,156,665
C. Von Siggern, U.S. Pat. No. 3,418,981
D. Folcke, U.S. Pat. No. 3,170,445
E. Miller, U.S. Pat. No. 3,680,305
F. Dolza, U.S. Pat. No. 3,092,089
G. "Extension of the Lean Missfire Limit and Reduction of Exhaust Emissions of a Spark Ignited Engine by Modifications of the Ignition and Intake Systems," Messrs. Ryan, Lestz and Meyer, Soc. Auto. Engrs. Paper No. 740105.
H. "An Evaluation of the Performance and Emissions of a CFR Engine Equipped With a Prechamber," Messrs. Wimmer and Lee, Soc. Auto. Engrs. Paper No. 730474.
I. "A New Look at Nitrogen Oxides Formation In Internal Combustion Engines," Messrs. Eyzat and Guibet, Soc. Auto. Engrs. Paper No. 680124.
J. "Influence of Engine Variables on Exhaust Oxides of Nitrogen Concentrations From a Multicylinder Engine," Messrs. Huls and Nickol, Soc. Auto. Engrs. Paper No. 670482.
K. "A Study of Compression Ignition," B. Singh, MS in ME Thesis, Univ. of Wash., Seattle, Wash., 1965.
L. "Some Factors Affecting Precombustion Reactions in Engines," Messrs. Corzilius, Diggs and Pastell, Soc. Auto. Engrs. Paper No. 852,1952.
M. "A Detonation Wave Theory of Gasoline Engine Knock," Firey, Sixth Symposium (International) on Combustion, Reinhold, 1957, p 878.
N. "The Ignition of Hydrocarbon Fuel Droplets In Air," G. M. Faeth and D. R. Olson, SAE Trans. 1968, Vol. 77, p 1793.
O. "A Study of the Effect of Fuel Properties Upon Diesel Engine Combustion," J. C. Firey, MS Thesis, University of Wisconsin, 1941.
P. "The Effects of Physical Factors on Ignition Delay," W. T. Lyn, E. Valdamis, SAE January Meeting 1968, Paper No. 680102.
Q. "The Ignition of Fuels by Rapid Compression," C. F. Taylor, E. S. Taylor, J. C. Linengood, W. A.

Russell, W. A. Leary, SAE Quarterly Trans., April 1950, Vol. 4, No. 2, p 232.
R. "Photographs at 500,000 Frames per Second of Combustion and Detonation in a Reciprocating Engine," T. Male, Third Symposium on Combustion Flame and Explosion Phenomena, Williams and Wilkins, Co., 1949, p 721.
S. "A Detonation Wave Theory of Gasoline Engine Knock," J. C. Firey, Sixth Symposium (International) on Combustion, Reinhold Co., 1957, p. 878.
T. "Exhaust Gas Hydrocarbons—Genesis and Exodus," Daniels and Wentworth, SAE Technical Progress Series, Vol. 6.
U. "Combustion Engine Processes," L. C. Lichty, McGraw Hill, 1967, p 334, p 405, p 490.
V. "The Effects of Engine Operating and Design Variables on Exhaust Emissions," D. F. Hagen and G. W. Holiday, SAE March meeting, 1962, Paper No. 486 C.
W. Barber et al, U.S. Pat. No. 2,484,009.
X. "A Study of the Possible Effect of the Atkinson Cycle on Oxides of Nitrogen Emission from Gasoline Engines," Jinendrakumar Munot, M.S. in M.E. Thesis, University of Washington, Seattle, Wash., 1976.
Y. Gau, U.S. Pat. No. 3,579,981.
Z. "A Spark Ignition Engine with an In-Cylinder Thermal Reactor," Jessel, Uyehara and Myers, SAE paper number 730,634, 1973.
AA. "Diesel Engine Exhaust Smoke: The Influence of Fuel Properties and the Effects of Using Barium Containing Fuel Additives," D. W. Golothan, SAE Trans., Vol. 76, p 616, 1967.
BB. Cole, U.S. Pat. No. 1,537,748.
CC. Burtnett, U.S. Pat. No. 1,481,955.
DD. Burtnett, U.S. Pat. No. 1,546,007.
EE. "Wetting the Appetite of Spark Ignition Engines for Lean Combustion," B. D. Peters and A. A. Quader, Soc. Auto. Engrs. Paper No. 780234.

SUMMARY OF THE INVENTION

The invention described herein achieves the same beneficial objects as described in the cross referenced related application and also by creating multiregional stratified air-fuel mixtures at engine intake. The invention herein differs from the cross referenced related application in that the stratifier valve is of mechanically simpler construction and widely different fuel types can be put into different regions even though but a single fuel supply and fuel tank are needed and these are added beneficial objects made available by this invention. The invention described herein makes possible the quieter engine running available when the different regions within the multiregional stratified mixture differ greatly in their compression ignition time delay characteristic when but a single, multicomponent fuel is being supplied to the engine.

Multicomponent fuels, containing many different kinds of molecules, differing in molecular weight, molecular structure and vapor pressure characteristics, are preferably used with the invention described herein. However single component fuels, containing essentially only one kind of molecule, can be used with this invention but it is not then possible to put different fuel types into different regions of the multiregional stratified air-fuel mixture. In almost all cases multicomponent fuels are also preferred as being easier to prepare from petroleum crude oil, from coal derived liquids, etc. than are single molecule type fuels and hence are less expensive and are more readily available.

An additional advantage of the invention described herein over the cross referenced related application is that the excess fuel necessarily used in the fuel-air mixing system during the cold starting of the engine can be saved and reused and need not be passed on through the engine to contribute to engine deterioration and unburned hydrocarbon pollution of the air.

The engine intake fuel fractionator and stratifier devices described herein are connected to the intake pipe or manifold of an internal combustion engine and replace the fuel flow control system and air-fuel mixing equipment commonly used on such engines. This invention is particularly well adapted for use with supercharged engines especially of the turbocharged type. When used with a turbocharged engine the engine intake fuel fractionator and stratifier devices of this invention are preferably placed between the compressor outlet of the turbocharger and the intake pipe of the engine.

To accomplish these several beneficial objects the engine intake fuel fractionator and stratifier devices of this invention must comprise at least a fractionator means for fractionally evaporating a moving liquid fuel into the engine intake air within an enclosure, a stratifier means for selecting differing air-fuel mixture regions from different positions along the path of the moving liquid in the fractionator and thus to create a multiregional stratified air-fuel mixture at engine intake, and a means for controlling liquid fuel flow rate into the fractionator in order to control engine power and torque. Additional elements may also be used for particular applications. For example, with most gasoline type fuels used today an intake air heater may be needed to accomplish evaporation within the fractionator. The fractional evaporation can also be greatly assisted by using an atomizer to atomize the moving liquid fuel within the fractionator in order to provide a large liquid surface area for transfer of heat from the intake air into the evaporating liquid. To improve fuel utilization efficiency during cold starting a droplet catcher can be provided in the fractionator enclosure to catch any liquid fuel not evaporated by the end of the liquid motion path and to return this collected liquid fuel back to the fuel tank for subsequent reuse.

Other elements and control elements may also be used in order to assure that full evaporation of the liquid fuel occurs within the fractionator enclosure and also to assure that none of the air-fuel mixture regions are overrich in fuel when the engine is operating fully warmed up. For example, a multichannel intake air heater of adequate capacity with flow adjusting dampers can be used to so distribute the flow of intake air into the fractionator relative to the motion of the liquid fuel within the fractionator as to assure both full evaporation of the liquid fuel and absence of over richness in any of the air-fuel mixture regions created within the fractionator enclosure. An air-fuel proportioner device can be added to this multichannel air heater to readjust the distribution of intake air flow into the fractionator as fuel flow rate is changed in order to assure both full evaporation and absence of overrichness over a wide range of liquid fuel flow rates. Some engines are required to use differing fuels at different times, these fuels differing widely in evaporation characteristics. For these engine applications a control scheme may be added comprising droplet sensors and air-fuel ratio sensors which act via a control device to readjust either the distribution of ntake air flow or the air temperatures into the fraction-
tor so as to assure the desired full evaporation and
bsence of overrichness.

The various elements and control elements, used in
ddition to the basic fractionator and stratifier and fuel
low control elements, may be used as described above
r in other combinations.

In operation this engine intake fuel fractionator and
tratifier produces differing air-fuel mixtures along the
ength of the liquid fuel motion path or droplet trajecto-
ies, said mixtures differing in the kinds of fuel mole-
ules present, differing in the air-fuel ratio, or differing
n both the air-fuel ratio and the kinds of fuel molecules
resent. As a liquid droplet travels through the heated
ir, along its trajectory from the atomizer through the
ractionator, heat transfers from the air to the liquid
ausing fuel molecules to evaporate into the adjacent air
nass. The small molecules of high vapor pressure will
referentially evaporate first whereas the large mole-
ules of low vapor pressure will tend to evaporate last.
s a result those air-fuel vapor mixtures created in the
irst part of the droplet trajectory will contain largely
he smaller molecules and those air-fuel vapor mixtures
reated in the last part of the droplet trajectory will
ontain largely the larger molecules and in this way
ractionation as to kind of evaporated fuel molecules
resent is created within the fractionator. The distribu-
ion of air-fuel vapor ratio along the length of the drop-
et trajectory can be varied by varying the flow rates
nd the temperatures of the separate air inlet flows to
he vaporizer along the length of the droplet trajectory
nd also by varying the relative content of high vapor
ressure molecules and low vapor pressure molecules
within the liquid fuel supplied to the atomizer. For
xample, if the fuel contains a larger proportion of small
nolecules a larger amount of fuel will vaporize in the
arly part of the fuel trajectory and produce there a fuel
icher air-fuel vapor mixture. Necessarily then, less fuel
will reach the latter part of the droplet trajectory and
he air-fuel vapor mixtures created there will be fuel
eaner. The same result could alternatively be produced
y increasing the air temperature of that air admitted to
he first part of the droplet trajectory.

During each engine intake process the stratifier valve
raws several separate regions of air-fuel vapor mix-
ure, each region coming from a different position along
he droplet trajectory and thus these separate regions
an be selected to differ from one another as to the kinds
f fuel molecules present and may also differ as to the
ir-fuel ratio. In this way the stratifier valve portion of
his engine intake fuel fractionator and stratifier device
an create a multiregional stratified air-fuel vapor mix-
ure at the intake of an internal combustion engine.
lso, by using a stratifier valve in this way in combina-
ion with a fuel fractionator we can create a multire-
ional stratified air-fuel mixture at engine intake
herein different kinds of fuel molecules are present in
ifferent regions even though but a single, multicompo-
ent fuel is supplied to the engine and this is one of the
eneficial objects made available by this invention. The
ross referenced related application describes several
ifferent kinds of adjustable stratifier valves. All of
hese earlier referenced stratifier valves were necessar-
ly designed to be adjustable in one way or another as
he means of controlling engine torque and this adjust-
ble requirement made these earlier stratifier valves
echanically complicated and expensive. For the en-
ine intake fuel fractionator and stratifier devices de-
scribed herein non adjustable stratifier valves are used and control of engine torque is accomplished more simply by control of fuel flow rate. Greater mechanical simplicity and lower cost are achieved by use of non adjustable stratifier valves which cannot be used with the earlier cross referenced application.

At least one engine intake fuel fractionator and stratifier device, as described herein, is needed for each intake manifold of an internal combustion engine independently of the number of engine cylinders connected to said intake manifold. In many engine applications we prefer to use but a single intake manifold and but a single engine intake fuel fractionator and stratifier device for all cylinders of the engine as producing the least mechanical complexity and cost. By connecting each engine fuel fractionator and stratifier device to at least four or more cylinders continuous flow of air into and mixture out of the fractionator can be obtained for four stroke cycle engines and is preferred.

BRIEF DESCRIPTION OF THE DRAWING

A cross sectional view of one form of the engine intake fuel fractionator and stratifier of this invention is shown in FIG. 1. Air enters the intake air heater section, 1, from the intake air horn or from the compressor outlet of the engine supercharger, if used, at 2. Engine exhaust gas, or other heating medium, passes through the pipe, 5, from 3 to 4. The heated air then flows via the several separate air channels, 6, 7, 8, into the vaporizer section, 9. Liquid fuel from the fuel tank and supply system flows via the fuel flow controller, 10, into the spinning disc, 11, of the spinning disc atomizer which is spun by a suitable drive means connecting thereto at 12. The air-fuel vapor mixtures created within the vaporizer section, 9, flow via the several separate air-fuel mixture channels, 13, 14, 15, 16, 17, to fixed ports, 18, 19, 20, 21, 22, of the stratifier valve, 23. The moving element, 24, and moving ports, 25, 26, 27, of the stratifier valve, 23, are driven by a suitable drive means connecting thereto at 28. The multiregional stratified air-fuel mixture created at outlet of the stratifier valve then flows into the engine intake manifold, 9, connecting to the intake ports of the engine. Commonly the vaporizer section and the stratifier valve would be angularly symmetrical about the centerline A—A, but this is not necessary.

DESCRIPTION OF THE PREFERRED EMBODIMENTS

Figure 1:
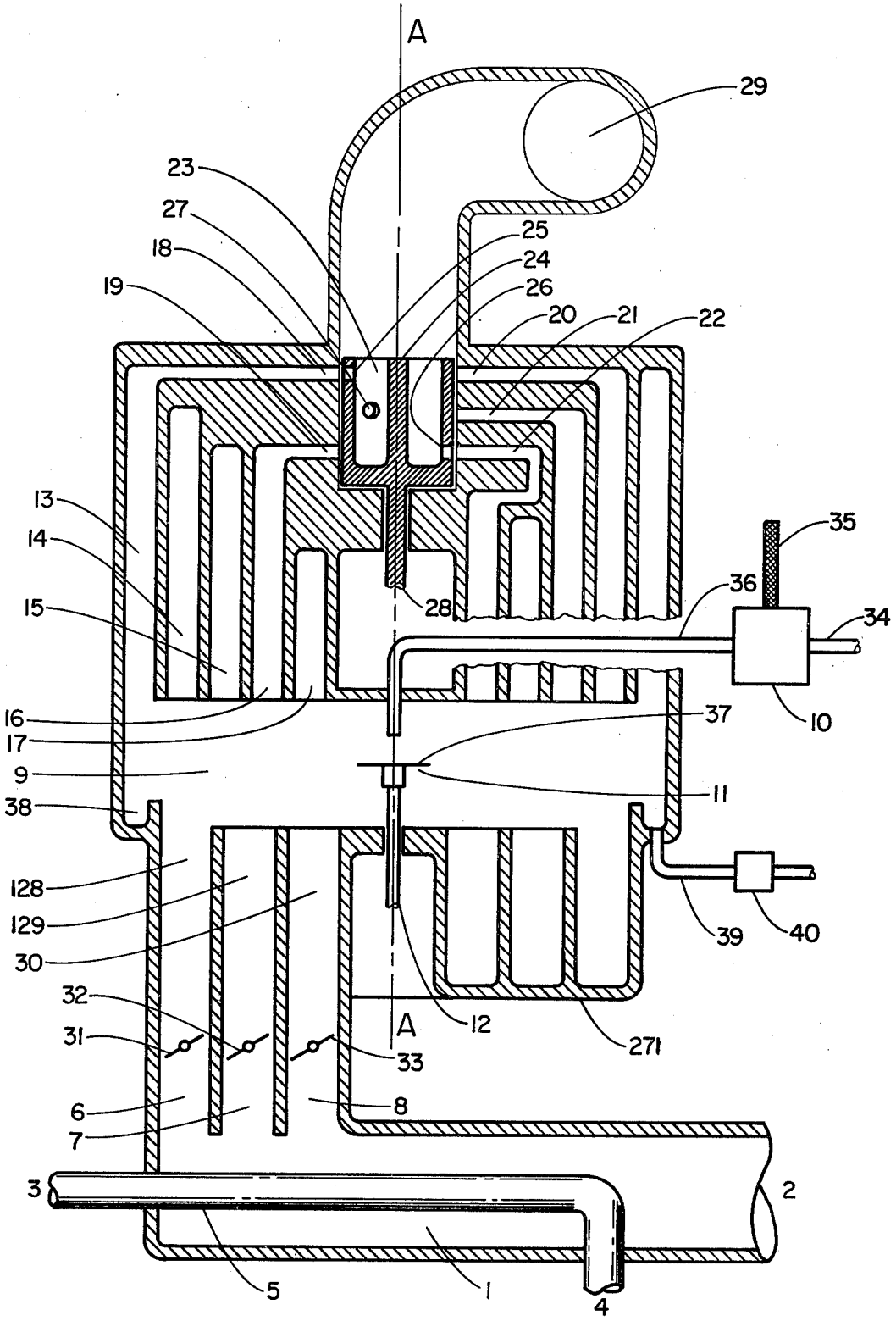

The engine intake fuel fractionator and stratifier devices of this invention are preferably used with turbocharged internal combustion engines. A turbocharger comprises a compressor, to increase the pressure of air supplied to the engine, driven by a gas turbine driven in turn by the engine exhaust gas and an engine so equipped is herein referred to as a turbocharged internal combustion engine. Other types of superchargers or engines with no supercharger can also be used with the devices of this invention.

For the preferred embodiment of this invention engine exhaust gas is used as the heat source for the intake air heater, a spinning disc atomizer is used to atomize the liquid fuel inside the fractionator section, and engine torque is controlled. This particular form of this invention is preferred as being mechanically simple and hence reliable. In FIG. 1 is shown a cross sectional view of one arrangement of this preferred embodiment of an engine intake fuel fractionator and stratifier. Compressed air from the compressor of the turbocharger enters the intake air heater section, 1, at its inlet, 2, and passes along the outside of the heater pipe, 5, which is heated by engine exhaust gases passing from 3 to 4 along the inside of the heater pipe, 5. The heated air passes from the intake air heater, 1, into the several separate air channels, 6, 7, 8 with the hottest air being in that channel, 6, whose air has passed over the greatest length of the heater pipe, 5, and with the coldest air being in that channel, 8, whose air has passed over the least length of the heater pipe, 5. The air inlet distributor, 271, contains angularly uniform distributor channels, 128, 129, 30, each connecting separately to but one of the separate air channels, 6, 7, 8, so that the heated air flows from the separate air channels through the air inlet distributor channels and enters the vaporizer section, 9, in an angularly uniform flow but with a radial variation of air temperature. As shown in FIG. 1 the hottest air from air channel 6 and distributor channel, 128, enters the vaporizer section, 9, near its outermost radius whereas the coldest air from air channel 8 and distributor channel 30 enters the vaporizer near its innermost radius, and hence the air temperature increases as radius within the vaporizer section, 9, increases. But other air temperature versus vaporizer radius patterns can be used if desired. In almost all engine applications it will be preferred that the hottest air be distributed to the outer radius of the vaporizer section, 9, as is shown in FIG. 1, in order to assure evaporation of the low vapor pressure liquid fuel portions which may survive to that radius. In some engine applications it may be preferable to distribute the coldest air at an intermediate radius into the vaporizer and to distribute air of an intermediate temperature near the innermost radius of the vaporizer in order to adapt the engine to a particular fuel. Only three separate air channels, 6, 7, 8, and the three distributor channels, 128, 129, 30, connected thereto are shown in FIG. 1 to avoid undue complexity of the drawing, but only one or any number of separate air channels and connected distributor channels can be used. The relative volumes of air flowing separately in the separate air channels, 6, 7, 8, and connected distributor channels, 128, 129, 30, can be adjusted by adjusting the flow restricting dampers or valves, 31, 32, 33, in order to adapt the engine to a particular fuel and assure full evaporation of all the liquid fuel admitted to the vaporizer section, 9. In some engine applications an adjustable air heater may be preferred as, for example, when different fuels, varying widely in vapor pressure properties, are intended to be used at different times in the same engine. Any of the known means of adjusting the air heater can be used for this purpose as, for example, providing a cold air supply pipe which bypasses the intake air heater, 1, and admits cold air to be mixed into one or more of the separate air channels, 6, 7, 8, through adjustable damper valves.

For highly turbocharged and otherwise highly supercharged engines the air temperature increase consequent upon such high compression may be adequate to assure full evaporation of all the liquid fuel supplied to the vaporizer section, 9, and an additional intake air heater device, 1, is unnecessary for such engines. For these engines the air flows directly from the compressor outlet, or intercooler outlet if an intercooler is used, into the several separate air channels, 6, 7, 8. The supercharger compressor itself becomes the intake air heater device as well as the intake air compressor.

Liquid fuel from the fuel tank and supply system enters the fuel flow controller, 10, via the pipe, 34. For the preferred torque control described here, the torque control lever, 35, controls the quantity of liquid fuel per engine revolution passed by the fuel flow controller, 10, via the pipe, 36, into the spinning disc, 37, of the spinning disc atomizer, 11. The torque control lever, 35, can be moved either by the engine operator, if hand or foot control of engine torque is desired, or by the engine governor if governor control of engine torque is desired. The fuel flow controller, 10, can be any of the devices or means, already well known in the art of liquid flow controllers to control liquid fuel flow rate per engine revolution. For example a positive displacement pump driven at some fixed multiple of engine RPM and with adjustable displacement could be used as the fuel flow controller, 10, and the torque control lever, 35, would then adjust the pump displacement. Other types of fuel flow controllers can also be used as, for example, a liquid flow rate control independent of engine RPM which would control engine power instead of engine torque.

Liquid fuel flows from the pipe, 36, on to the spinning disc, 37, of the spinning disc atomizer, 11, at or near the center of rotation of the disc. The liquid fuel on the spinning disc is speeded up to very nearly the same speed as the disc and the resultant centrifugal force causes the liquid fuel to move outward radially on the disc and to be progressively speeded up to the higher disc speed prevailing at greater disc radius. Finally the liquid fuel is thrown off the edge of the spinning disc with a tangential component of velocity very nearly equal to the speed of the outer edge of the disc and also with a radial component of velocity. The liquid fuel leaving the spinning disc is quickly atomized into tiny droplets partly by the spreading of the liquid sheet as radius increases and partly by the aerodynamic forces acting on the liquid due to its high velocity relative to the adjacent air. The spinning disc, 37, is rotated at high speed by any suitable drive means, such as by an electric motor or by gears or belts from the engine crankshaft, via the disc drive shaft, 12. We want to thusly atomize the liquid fuel within the vaporizer section, 9, in order to increase the area of contact between the liquid fuel and the heated intake air so that sufficient heat can be transferred from the heated air into the liquid fuel to evaporate the liquid completely before the droplets reach the outermost radius of the vaporizer section, 9. The higher the speed of the outer edge of the spinning disc the smaller becomes the average liquid droplet size and the greater becomes the area available to transfer heat from the heated air into the liquid droplet as is well known in the art of spinning disc atomizers.

The spinning disc type of liquid atomizer is particularly well suited for this invention since the small flow volume of liquid fuel can be easily metered at low pressures but fine atomization can nonetheless be secured at the high velocities of the spinning disc. With the angularly symmetrical radial outflow motion of the liquid droplets from a spinning disc atomizer we prefer the air to flow into the fractionator and the mixtures to flow out of the fractionator also with angular symmetry so that the air and fuel flow together in the same way at all angular positions. For this the fractionator enclosure and the air inlets thereto and mixture outlets therefrom are preferably angularly symmetrical about the spinning disc axis and hence are of rather simple construction as shown in FIG. 1. Other types of liquid fuel atomizers can also be used as, for example, stationary pressure atomizing nozzles or rotating pressure atomizing nozzles. In lieu of an atomizer, a rotating wire screen or perforated disc could also be used and positioned and spun within the vaporizer section, 9.

Within the vaporizer section, 9, heat transfers from the heated air into the atomized liquid droplets causing fuel to evaporate into the adjacent air and air fuel vapor mixtures are thusly created within the vaporizer section. As a fuel droplet travels along its trajectory from the edge of the spinning disc, 37, toward the outer surface of the vaporizer section those fuel molecules of high vapor pressure will at first evaporate more rapidly than those of low vapor pressure and thus the air-fuel vapor mixtures formed close to the spinning disc will be richer in high vapor pressure molecules and leaner in low vapor pressure molecules. By the time a liquid fuel droplet reaches the outer radii of the vaporizer section, 9, it is largely depleted of high vapor pressure molecules and hence the low vapor pressure molecules evaporate here into the adjacent air and these air-fuel vapor mixtures will be richer in low vapor pressure molecules and leaner in high vapor pressure molecules. In consequence the fuel is fractionated within the vaporizer section, 9, the average vapor pressure of the evaporated fuel fractions decreasing progressively with increasing radius away from the spinning disc, 37. Also in consequence the compression ignition time delay characteristics of the air-fuel vapor mixtures can also vary along a radius of the vaporizer section since different proportions of differing fuel molecules are located in the air-fuel vapor mixtures formed by different fuel fractions evaporating at different positions along the droplet motion paths.

The assembly of the vaporizer section, 9, and the liquid fuel atomizer, 11, taken together, function as a fractionator or means for fractionally evaporating a moving multicomponent liquid fuel so that different fuel fractions are evaporated into adjacent air at different positions along the motion paths of the moving liquid. In this way the fractionator makes available to the stratifier valve a wide variety of different air-fuel mixture regions differing not only in the proportions of fuel molecules present, as described above, but also in the air-fuel ratio as described below.

In almost all engine applications we prefer that all the atomized liquid fuel be fully evaporated into the intake air mass when the engine is running normally and fully warmed up. We also usually prefer that none of the separate regions of air-fuel vapor mixture within the multiregional stratified air-fuel vapor mixture at engine intake be very much, if any, richer than about the chemically correct air-fuel ratio so that fuel combustion can be complete and efficient. The full evaporation object can be achieved by using adequately high air inlet temperatures into the vaporizer, particularly of that air channel admitting air into the last part of the droplet trajectory, and also by selection of the kinds and sizes of fuel molecules put into the liquid fuel originally in the tank. Over richness can be avoided by adapting the air inflow distribution pattern and the air temperature pattern along the length of the droplet trajectory to the flow rate and vaporization pattern of the liquid fuel being used.

The ratio of air to fuel vapor of the air-fuel vapor mixtures formed within the fractionator may also vary along a radius of the vaporizer. This variation of air-fuel vapor ratio along a vaporizer radius can be controlled as desired by design or control of one or more of the following: the distribution of air flow from the several separate air channels, 6, 7, 8, into the vaporizer section, 9, at different radii therein; the distribution of air temperatures between the air flows in these several separate air channels; the distribution of different kinds of fuel molecules and hence of different fuel vapor pressures within the original liquid fuel supplied by the fuel flow controller, 10, to the spinning disc atomizer, 11. With these three independent controls available almost any desired variation of air-fuel vapor ratio along a radius within the vaporizer section can be achieved. For most engine applications using typical liquid fuels derived from petroleum, and within the usual gasoline boiling range, it is preferred that the air-fuel vapor ratio become leaner in fuel as radius increases within the vaporizer section. The air-fuel vapor ratio at the shortest radius, close to the spinning disc, is preferably little or no richer in fuel than the chemically correct ratio of air to fuel vapor. The air-fuel vapor ratio at the longest radius, close to the outer wall of the vaporizer section, is preferably adjusted so that air-fuel vapor regions formed here are either spark ignitable or will assuredly undergo compression ignition within the engine cylinder before the engine piston has moved more than about 60 crank degrees down on the expansion stroke. Hence the preferred air-fuel vapor ratio which is leanest in fuel, at the outer vaporizer section radius, depends upon the kind of fuel being used, the overall compression ratio of the engine, and the maximum RPM of the engine. In summary, it is preferred that the ratio of air to fuel vapor become leaner in fuel with increasing radius within the vaporizer section from no richer in fuel than chemically correct air-fuel vapor ratio at the innermost radius down to no leaner in fuel than can be either spark or compression ignited within the engine before expansion has proceeded appreciably. This particular variation of air-fuel vapor ratio with vaporizer radius is preferred for the following reasons:

1. The fuel richest regions will contain mostly the smaller molecules which, on average, have longer compression ignition time delays. These richer regions will then have time to be spark ignited and burned without being compression ignited and quieter engine running will obtain. Compression ignition of chemically correct air-fuel vapor mixtures is rapid and noisy. But these richer regions are not to be much richer than about chemically correct so that fuel combustion can be essentially complete and efficient.
2. The fuel leanest regions will contain mostly the larger molecules which, on average, have shorter compression ignition time delays. Were these larger molecules to be in regions at or near chemically correct air-fuel vapor ratios these regions would easily undergo noisy compression ignition before the quieter spark ignition could take place. Compression ignition becomes slower and quieter when the air-fuel vapor ratio becomes leaner in fuel than the chemically correct ratio.
3. It is essential that all the fuel-air mixture regions formed be ignited and burned completely within the engine cylinder reasonably close to the time when the engine piston is at top dead center between compression and expansion, in order to assure high engine efficiency. Hence the regions leanest in fuel must either be spark or flame ignitable or, if leaner than spark ignitable, must be compression ignitable within the engine during the preferred time interval.

Other variations of air-fuel vapor ratio with vaporizer radius may also be used and, under certain conditions may be preferred. For example, it is possible to create multicomponent fuels wherein the shorter compression ignition time delays are associated with the smaller molecules in reversal of the usual case. For these unusual fuels the air-fuel vapor ratio would preferably become richer in fuel with increasing vaporizer radius for the same reasons cited above for the usual type of fuel. Where the engine is to run by compression ignition alone, without use of spark ignition, the air-fuel vapor ratio might preferably be about constant along the vaporizer radius since this variation allows best utilization of the available air quantity for maximum torque.

The preferred fuel enrichening with decreasing vaporizer radius can be secured by admitting heated air only at the outermost radius of the vaporizer section, 9, that is only via the single separate air distributor channel 128 of FIG. 1. Those air portions which flow radially inward within the vaporizer section can only become fuel vapor richer in doing so, since to the fuel vapor acquired by these air portions at outer radii is added additional fuel vapor at the inner radii. Hence the air-fuel vapor ratio will become fuel vapor richer with decreasing vaporizer radius, as preferred, when all air is admitted only at the outermost radius of the vaporizer. If the air-fuel vapor ratio at the innermost radius is fuel richer than the chemically correct ratio some heated air may be admitted to the vaporizer section at radii shorter than the outermost via the separate air distributor channels 129 and 30 and this air, being initially free of fuel vapor at these shorter radii, will make fuel leaner the air-fuel vapor mixtures existing at these radii. In this way the air-fuel vapor ratio at the innermost radius may be adjusted to being little or no richer in fuel than the chemically correct ratio. At the same time the air-fuel vapor ratio at the outermost radius necessarily becomes richer in fuel since less air is admitted at the outer radius whenever some air is being admitted at shorter radii. In this way the compression ignition time delay of the air-fuel vapor mixture at the outermost radius may be shortened, by such fuel enrichment, until this mixture may compression ignite within the engine near piston top dead center as desired. The relative flow of air as between the several separate air distributor channels, 128, 129, 30, from the intake air heater section, 1, into the vaporizer section, 9, can be adjusted as described above by adjustment of the flow restricting dampers, 31, 32, 33. Where a particular fuel is used in a particular application of a preferred turbocharged engine the flow restricting dampers, 31, 32, 33, can be once hand adjusted, and then locked, to achieve the desired air-fuel vapor ratio variation with radius and with full evaporation of all liquid fuel, without further need of adjustment. This is one way of accommodating engines, fuels and applications to each other for efficient engine operation.

We thus have at hand several ways to accommodate engines and fuels to one another. For a particular fuel composition we can adjust the air heaters, and hence the inlet air temperatures, as well as the radial distribution of air inflow to the vaporizer so that all the fuel will be evaporated and overrichness will be avoided in all regions. Also, for a particular arrangement of the air heaters and the air inflow radial distribution we can adjust the molecular composition of the fuel so that all the fuel will be evaporated and overrichness will be avoided in all regions. It can be in this way that engines and fuels are accommodated to each other for efficient operation of the system.

The vaporizer section, 9, is shaped to enclose the spray of liquid droplets coming from the atomizer, 11, and thus for the spinning disc atomizer a round vaporizer section cavity is used as shown in FIG. 1. The depth of the vaporizer section cavity along the direction of the axis of spin of the spinning disc, 37, is made large enough so that droplets cannot impinge upon the interior surfaces of the vaporizer section except at the outermost radius where the droplet catcher, 38, is located. The individual liquid droplets leaving the atomizer must spend enough time within the vaporizer section, 9, to become fully evaporated before reaching the outermost radius. As the speed of the outer edge of the spinning disc, 37, increases the time available for evaporation within a particular outer radius of the vaporizer decreases, since the average speed of the droplets increases, but the rate of heat transfer to the droplet also increases since smaller droplets are produced. An approximate analysis of these effects indicates that the outer radius of the vaporizer should be increased in proportion to the square root of the outer radius of the spinning disc, 37. Heat transfer to the droplets is also increased by higher air temperatures and by the higher air flow speeds of higher engine RPM. Very approximately the outer radius of the vaporizer section should be increased in proportion to the reciprocal of the product of engine RPM and the difference between air temperature and liquid droplet temperature.

A liquid fuel droplet which fails to evaporate completely before reaching the outer radius of the vaporizer section, 9, will impinge upon the outer surface thereof and run down into the droplet catcher, 38. Such unevaporated liquid portions can then be returned to the fuel tank via the retank pipe, 39, and the retank regulator, 40. For the preferred turbocharged engine case the supercharge pressure will usually be adequate to force such unevaporated liquid portions back to the fuel tank and a simple float operated liquid trap can be used for the retank regulator, 40, passing only liquid when present and closing to prevent escape of supercharged air-fuel mixture. Any of the other well known types of liquid traps can alternatively be used for the retank regulator, 40. For atmospherically aspirated engines, where no pressure of supercharge will be available to force liquid fuel back to the tank, the retank regulator, 40, can act to turn on a retank pump if needed whenever liquid fuel is present in the droplet catcher, by means already well known in the art.

When an engine is running normally and fully warmed up the droplet catcher, 38, and retank system are inoperative since the air heater system, the vaporizer section and the liquid fuel atomizer are designed and adjusted so that all liquid droplets are fully evaporated before reaching the droplet catcher, 38, as described above. It is during the cold starting and subsequent warmup of an engine that the droplet catcher, 38, and retank system operate for it is then necessary to supply a great excess of liquid fuel via the fuel flow controller, 10, to the liquid atomizer, 11, since only a small portion of this liquid fuel can evaporate at the cold air temperatures of starting and warmup, as is well known in the art. In a conventional gasoline engine, using a carburetor to create the intake air fuel mixture, this excess liquid fuel for cold starting and warmup is unavoidably swept on into the engine cylinder and must subsequently be emitted via the exhaust or the crank- :ase vent into the atmosphere as unburned hydrocarbon ›ollutants since no excess air is available to burn it. Fuel s also wasted in this way when used in a conventional, :arburetor equipped, gasoline engine since this excess 'uel is not burned to generate power. It is a beneficial ›bject of my invention to avoid this fuel wastage and ıtmospheric pollution with unburned hydrocarbons by ısing the droplet catcher, 38, and retank system, as lescribed above, to prevent the excess fuel of cold start ınd warmup from entering the engine and to return it to he fuel tank to be subsequently burned efficiently when he engine is fully warmed up.

Other shapes of the vaporizer section can also be ısed. For example, when stationary pressure atomizer ıozzles are used the vaporizer section could be a verti- :al cavity with one or more atomizer nozzles at the top praying liquid fuel downward parallel to the centerline ›f a cylindrical or conical vaporizer section cavity. The everal separate air distributor channels could admit ıeated air at various positions along the vertical length ›f the vaporizer and also the several separate air-fuel nixture channels could withdraw the air-fuel mixtures ıt various other positions along the vertical length of he vaporizer section. The droplet catcher could then ›e the enclosed bottom of the vaporizer section. This /ertical fractionator would then function to create the everal separate air-fuel mixtures, differing amongst hemselves as to air-fuel vapor ratio and as to types of 'uel molecules, in exactly the same manner as the fraclonator described above for the spinning disc atomizer ınd differs therefrom principally in the geometric shape ›f the vaporizer section.

The several separate air-fuel mixture channels, 13, 14, 15, 16, 17, connect the vaporizer section, 9, to the fixed ›orts, 18, 19, 20, 21, 22, of the stratifier valve, 23. When ı moving port, 25, indexes with a fixed port, 18, of the tratifier valve, 23, air-fuel mixture flows through the eparate air-fuel mixture channel, 13, from that radius of he vaporizer section at which this particular channel :onnects thereto, through the air-fuel mixture channel ınd fixed port and moving port and on into the engine ntake manifold, 29. The air flow and fuel flow into the /aporizer section being angularly uniform it is also ›referable that each separate air-fuel mixture channel be imilarly angularly uniform in its connection into the /aporizer section as is shown in FIG. 1. The several eparate air-fuel mixture channels differ, in being conıected into the vaporizer section at different radii or at lifferent positions along the droplet trajectories therein, ınd in connecting to different fixed ports of the stratifier /alve. Hence the air-fuel mixtures flowing within the everal separate air-fuel mixture channels are different n each channel since they are drawn from different ›ositions along the fuel droplet trajectory. It is in this vay that the several separate air-fuel mixture channels nake available at the fixed ports of the stratifier valve a /ariety of kinds of air-fuel vapor mixtures from which he multiregional stratified engine intake charge can be ›repared by action of the moving ports of the stratifier /alve. Each separate air-fuel mixture channel connects o at least one fixed port of the stratifier valve and each uch fixed port connects to but a single separate air-fuel nixture channel. The number of different kinds of air-uel vapor mixture available at the fixed ports of the tratifier valve is equal to the number of separate air-uel mixture channels, 13, 14, 15, 16, 17, which is five for he device shown in FIG. 1. Only five separate air-fuel nixture channels are shown in FIG. 1 to avoid undue complexity of the drawing but more than five separate air-fuel mixture channels are preferred.

The stratifier valve, 23, contains the fixed ports, 18, 19, 20, 21, 22, connecting to the several separate air-fuel mixture channels as described above, and the moving element, 24, containing the moving ports, 25, 26, 27, each of which can index with some fixed ports at some portion of its motion. The outlet of the moving ports and hence of the stratifier valve connects to the engine intake manifold, 29. A rotating moving element, 24, is shown in FIG. 1 but other motion patterns can also be used such as oscillating or vibrating as described in the Cross Referenced related application. Any suitable drive means can be used to move the moving element of the stratifier valve such as an electric motor, a belted or geared or chained drive from the engine crankshaft or camshaft, etc. For example the rotating moving element shown in FIG. 1 could be belt driven from the engine crankshaft via a pulley connecting to the moving element shaft at 28. The moving element, 24, must contain at least one moving port, 25, and preferably contains many moving ports. The number of moving ports to be used depends upon the rotational speed or oscillation speed of the moving element, 24, and the engine noise quality of the multiregional stratified air-fuel mixture desired at engine intake. The greater the total number of individual regions within the multiregional air-fuel mixture and hence the smaller their average individual volume the quieter the engine noise becomes. For a given desired engine noise quality the required total number of individual regions in the multiregional air-fuel mixture can be secured with only one moving port rotated at a high speed or with several moving ports rotated at a moderate speed. To avoid unnecessary throttling of the flow of air-fuel mixture into the engine it is preferable that the fixed and moving ports be arranged so that at least one fixed port and a moving port be indexed at all positions the moving element occupies during its cycle of movement, but different fixed ports and moving ports can be indexed at different positions. In this preferred way the passage from the vaporizer section into the engine intake manifold is never completely blocked off during the engine intake processes.

The full or partial alignment of one moving port with one fixed port is referred to as an indexing or connecting. When a moving port and a fixed port are thusly indexed or connected during the intake stroke of a cylinder of the engine the engine intake process will draw a region of air-fuel vapor mixture from that fixed port, through that moving port and on into the engine intake pipe and then the engine cylinder.

When the moving element of the stratifier valve makes one or several connectings together at the same time these one or several connectings are herein and in the claims referred to as a group of connectings. A sequence of several such groups of connectings will take place in succession with each full rotation or cycle of oscillation of the moving element of the stratifier valve and this sequence will then be repeated upon the next cycle of rotation or oscillation of the moving element. The term sequence or full sequence of groups of connectings is used herein and in the claims to describe this cyclic process for each full cycle of the moving element of the stratifier valve. Two groups of connectings one immediately after the other in the sequence are herein referred to as successive groups of connectings. During the intake process for a single engine cycle of a particular cylinder of the engine the moving element of the stratifier valve will preferably rotate or oscillate through several cycles and hence several sequences of groups of connectings can be carried out during said engine cycle and that entire set of connectings is herein and in the claims referred to as the batch of connectings for a single engine cycle.

When a fixed port or two different fixed ports connect to different air-fuel mixture channels these connections are herein referred to as differing connectings since they connect into the fractionator at different positions along the motion path of the liquid fuel. Hence the air-fuel mixture regions drawn through such differing connections will differ as to the fuel fractions present and may differ as to the air-fuel ratio.

Where the moving element of the stratifier valve contains more than one moving port some or all of these moving ports could be adjacent to one another. Connectings made simultaneously by such adjacent ports and also connectings made immediately in succession by a single port or by adjacent ports are herein referred to as adjacent connectings. Hence the air-fuel mixture regions drawn through such adjacent connectings will be adjacent to each other within the multiregional stratified air-fuel mixture created in the engine intake pipe. Connectings can be thusly adjacent within a single group of connectings or as between two successive groups of connectings.

Where moving ports are separated, by at least one full width of the opening of the port, when connectings are made these connectings, thusly separated, are herein referred to as non-adjacent connectings. The air-fuel mixture regions drawn through such non-adjacent connectings will not be adjacent to each other within the multiregional stratified air-fuel mixture created in the engine intake pipe. Connectings can be thusly non-adjacent within a single group of connectings or as between two groups of connectings.

A particular moving port may make connectings in immediate succession into two successive groups of connectings and such connectings are herein referred to as successive connectings. The air-fuel mixture regions drawn through successive connectings will be adjacent regions within the multiregional air-fuel mixture created in the engine intake pipe.

The several separate air-fuel mixture channels, 13, 14, 15, 16, 17, taken together with the fixed ports, 18, 19, 20, 21, 22, and the moving ports, 25, 26, 27, and the stratifier valve and drive means therefore constitute a means for making a batch of separate connectings of the intake pipe, 29, of the engine into the fractionator wherein separate connectings can differ as to the position along the motion paths of the liquid fuel connected into and hence can differ as to the kinds of regions drawn into the engine intake manifold. It is the function of this means for making a batch of separate connectings to create the desired multiregional stratified air-fuel mixture at engine intake by drawing several air fuel vapor mixture regions during each engine cycle from several different positions along the droplet trajectories within the fractionator. Since the air-fuel vapor mixtures created along the droplet trajectories differ as already described these several air-fuel vapor mixture regions will also differ thusly. Adjacent regions within the multiregional stratified air-fuel vapor mixture are to differ but the several regions need not be of the same volume. When, for example, two regions drawn from the same position along the droplet trajectory happen to become adjacent due to the flow of the multiregional mixture through the stratifier valve and the engine cylinder the net result is a single final region larger than the original two regions. The net effect of such a larger region is to decrease the total number of regions within the multiregional air-fuel mixture going into the engine cylinder and thus to increase the engine noise somewhat.

To minimize such increase of engine noise due to adjacency of identical regions we seek to so arrange the fixed ports and the moving ports of the stratifier valve that one or more of the following porting requirements are met in whole or part.

a. Where the moving element of the stratifier valve contains but a single moving port, successive connectings are to be differing connectings.
b. Where the moving element of the stratifier valve contains more than one moving port, adjacent connectings are differing connectings.
c. Where the moving element of the stratifier valve contains more than one moving port, successive connectings are to be differing connectings.

In this invention a non-adjustable stratifier valve is used and all of the applicable foregoing porting requirements can be met by design and arrangement of the fixed ports and the moving ports of the stratifier valve by methods already well known in the art of multiported valves. Where an adjustable stratifier valve is required, as in the cross referenced related application, it is not always possible to meet all of the applicable porting requirements over the entire range of adjustment of the stratifier valve. It is a beneficial object made available by this invention that non-adjustable stratifier valves can be used and hence that all applicable porting requirements can be met, with resulting improvement of engine noise quality. Also such non-adjustable stratifier valves are mechanically simpler and less costly than adjustable stratifier valves. It is not, however, necessary that all of the applicable porting requirements be met or that they all be met fully. In some engine designs it may prove advantageous to fail to meet some of the applicable porting requirements or to fail to meet some of the applicable porting requirements fully or both, in order to simplify further the stratifier valve construction and hence to reduce further its cost of manufacture. In all cases, however, at least some of the applicable porting requirements must be met at least partially in order to create a multiregional stratified air-fuel mixture at engine intake and hence to achieve the beneficial objects made available by this invention.

To create minimum multiregionality in the stratified air-fuel mixture at engine intake requires that no single air-fuel mixture channel shall be used to create regions all of which are adjacent as between all groups of a full sequence and up to the start of the next sequence. Such continuity of adjacency of identical regions between all groups for a full cycle of the moving element of the stratifier valve would produce a single continuous region of the same kind throughout that full cycle and all succeeding or preceding cycles and hence throughout the entire stratified air-fuel mixture at engine intake. Hence full multiregionality would not be obtained when such continuity of adjacency of identical regions obtained. By arranging that each air-fuel mixture channel is not used for at least one group of connectings in the full sequence of groups we can prevent continuity of adjacency of identical regions. Preferably, however, all air-fuel mixture channels are used in all groups of a full sequence so that continuous flow is obtained in each mixture channel. By requiring that all mixture channels which are used in all groups of a sequence shall make non-adjacent connectings as between two successive groups at least once within the full sequence we can prevent continuity of adjacency of identical regions through the entire cycle of the moving element of the stratifier valve. In this way full multiregionality of the stratified air-fuel mixture at engine intake can be obtained even though all mixture channels are used in all groups of a full sequence.

For best multiregionality of the stratified intake mixture, all identical regions are to be non-adjacent and this preferred result can be secured by applying the following requirements together:

a. All air-fuel mixture channels are used in all groups of connectings in a full sequence of groups.
b. Each mixture channel makes non-adjacent connectings as between all pairs of successive groups of connectings in a full sequence of groups.
c. Each mixture channel makes non-adjacent connectings within each group of connectings in a full sequence of groups.

When best multiregionality is obtained in this way minimum engine noise results.

From the outlet of the stratifier valve, 23, the multiregional stratified air-fuel mixture created thereby passes directly into the engine intake manifold, 29, and from thence passes on into each engine cylinder via the engine intake valves or ports during each intake process of the engine.

With a spinning disc atomizer we clearly prefer the flow of air to be continuous into the vaporizer section and the flow of air-fuel mixture also to be continuous not only out of the vaporizer section but also through each air-fuel mixture channel, since the flow of liquid fuel is continuous into the vaporizer section. For example, were the flow of air into the vaporizer to stop for an appreciable period of time the liquid fuel might not evaporate fully during such a time interval and unevaporated fuel would enter the droplet catcher to be returned to the tank. Hence engine torque and power would be inadequate since the retanked fuel would not then be burned to produce power. Also the retanked fuel would be partially depleted of high vapor pressure fractions and continuing such retanking would gradually change the tank fuel so that it became very low in those fractions. Subsequently the fractionator could no longer supply these high vapor pressure fractions into those regions created early in the droplet motion, and these regions could become non-ignitable, reducing engine efficiency. For this reason the engine intake fuel fractionator and stratifier devices of this invention are not particularly well suited for use on single cylinder internal combustion engines where air flow necessarily stops for an appreciable portion of each engine revolution.

Continuous flow of air into and mixture out of the fractionator can be obtained by connecting each fractionator to a sufficient number of cylinders of a multicylinder engine, these several cylinders being selected as timed relative to each other so that air flow to these several cylinders is continuous. For example, a four cylinder, four stroke cycle engine will have essentially continuous air flow and a single fractionator element would be preferably used with such a four cylinder engine. For four stroke cycle engines of more than four cylinders a single fractionator may still be preferred as mechanically simpler but each fractionator used is in any event preferably to be connected to that group of at least four cylinders which are so timed relative to each other as to assure continuous air flow. For two stroke cycle engines each fractionator is preferably connected to at least two cylinders, suitably timed, and more than two cylinders may be necessary to secure continuous air flow depending upon the porting arrangement used on the engine. Finally to secure continuous air flow into the fractionator we require that at least one fixed port and a moving port be indexed at all positions the moving element of the stratifier valve can occupy during its cycle of movement so that a flow passage always exists between the fractionator and the engine intake manifold.

Continuous flow of air-fuel mixture through each air-fuel mixture channel can be obtained by requiring that all air-fuel mixture channels are used in all groups of connectings in a full sequence of groups. This requirement also assures that a flow passage always exists, not only between the fractionator and the engine intake manifold, but also between the engine intake manifold and each air-fuel mixture channel.

These continuous flow requirements described above are preferred as explained but are not necessary to achieve the beneficial objects made available by this invention. When continuous flow is not fully obtained the flow will be more pulsating within the fractionator and within air-fuel mixture channels but the moving liquid fuel will still be fractionally evaporated and a multiregional stratified air-fuel mixture can still be created in the intake pipe of the engine.

The spinning disc type atomizer distributes the fuel equally into all equal angle segments and hence with angular symmetry about the disc spin axis. Preferably the air inflow and air-fuel mixture outflow of the vaporizer section are also thusly angularly symmetrical so that the fuel and the air flow together similarly in all equal angle segments. The air inlet distributor, 271, and air distributor channels, 128, 129, 30, taken together with the entry portions of the separate air-fuel mixture channels, 13, 14, 15, 16, 17, constitute the means for distributing the air flow into and out of the vaporizer section of the fractionator and we prefer this means to perform this function with angular symmetry of both the flow of air into and the flow of air, with admixed fuel vapors, out of the vaporizer section. This preferred result can be achieved by making each of the air distributor channels, 128, 129, 30, and also each entry portion of the air-fuel mixture channels, 13, 14, 15, 16, 17, angularly symmetrical about the spin axis of the spinning disc atomizer and nested inside of each other more or less like a nested set of concentric round cookie cutters of several different diameters. Preferably also air is admitted on one side of the liquid fuel droplet motion paths and the air-fuel mixtures are withdrawn from the opposite side, as is shown in FIG. 1, so that the air flow crosses through the droplet motion paths and excellent heat transfer can be obtained from the heated air into the evaporating liquid fuel. With these above described arrangements of the air distributor channels and the air-fuel mixture channels, relative to a spinning disc atomizer, the air-fuel mixture regions created in the vaporizer section are essentially alike at all angles at equal distances along the liquid fuel motion paths as to the air-fuel ratio and also as to the fuel vapor fractions present in the mixture. At differing positions along the motion paths of the liquid fuel the air-fuel mixture regions created in the vaporizer section differ as to the fuel vapor fractions present and the air-fuel ratio. Hence differing regions flow into the air-fuel mixture channels because they connect into the fractionator at differing positions along the liquid fuel motion path. But into any one air-fuel mixture channel the same identical air-fuel mixture flows at all angular portions because both the air-fuel mixture channel and the air flow, the fuel flow and the fuel fractionation taken together are angularly symmetrical about the spin axis.

As the multiregional stratified air-fuel mixture flows from the engine intake pipe, 29, into the engine cylinder it may happen that a pair of identical regions which were non-adjacent in the intake pipe become adjacent within the cylinder due to the manner of flow therein. The result would be a single larger region of that kind and a consequent increase of engine noise. The probability of occurrence of such subsequent adjacency of identical regions decreases as the number of differing regions, and hence the number of air-fuel mixture channels, 13, 14, 15, 16, 17, is increased. For example, if only two mixture channels and thus only two kinds of regions are used the probability of subsequent adjacency of identical regions is high and almost approaches a certainity. On the other hand if there are no pairs of identical regions, and hence an impractically large number of mixture channels is being used, subsequent adjacency of identical regions cannot occur. It is in order to adequately reduce the probability of occurrence of subsequent adjacency of identical regions that at least five air-fuel mixture channels, and preferably more than five, are required for this invention.

Each air-fuel mixture channel must be connected into at least once in each full sequence of groups of connectings and this requirement taken together with the requirement for at least five air-fuel mixture channels determines the minimum number of groups in a full sequence. Thus if but one moving port or other single connecting means is used at least five groups are required in the full sequence and each of these must be differing connectings. For two moving ports at least three groups are necessary in a full sequence to assure use of at least five channels. When three or more connecting means are used at least two groups of connectings are required in a full sequence of groups. More groups can be used in a full sequence than these minimum values and is preferable as reducing to some extent the probability of occurrence of subsequent adjacency of identical regions.

In an atmospherically aspirated engine, overall air-fuel ratio necessarily increases as fuel flow rate per engine revolution is increased, in order to increase engine torque, since air flow per engine revolution remains essentially constant. To avoid over rich regions at the early parts of the droplet trajectory in the vaporizer section we want to increase air flow into these early parts of the droplet trajectory and correspondingly decrease air flow into the outermost radius of the vaporizer as torque increases. The net effect of this air flow redistribution is to be that the air-fuel vapor ratio becomes gradually more nearly uniform and approaches to about chemically correct along the full length of the droplet trajectory as engine torque is increased by increase of fuel flow rate per engine revolution. This desired redistribution of air flow, via the several separate distributor channels, 128, 129, 30, into the vaporizer section, 9, can be accomplished with an air-fuel proportioner linkage connecting the torque control lever, 35, to the adjustment levers of the flow restricting dampers, 31, 32, 33, within the several separate air channels, 6, 7, 8, said air-fuel proportioner linkage being designed and adjusted to increase the flow of air through distributor channel 30 and perhaps channel 129 also and correspondingly to decrease the flow of air through distributor channel 128 as fuel flow rate per engine revolution is increased via adjustment of torque control lever, 35.

The vapor fractionator device described herein is particularly well adapted for use with supercharged engines especially of the turbosupercharger type. The compressor of the supercharger is preferably located upstream of the air heater so the entire engine intake fuel fractionator and stratifier operates at about supercharger air pressure. For a turbocharged engine it may only be necessary to increase total air flow to the engine as fuel flow increases to avoid overrichness in all regions and this can be accomplished by speeding up the exhaust gas driven turbine and hence also the air compressor thus increasing the inlet air pressure to the engine. The speed of the exhaust has driven turbine can be controlled by control of turbine nozzle area or by control of an exhaust gas dump valve bypassing the turbine with means already well known in the art of turbosuperchargers. Hence the air-fuel proportioner can act to sense fuel flow rate per engine revolution and respond by increasing the turbocharger speed as fuel flow rate increases and means for such sensing and responding are already well known in the art.

When the maximum possible engine power or torque output is desired from a turbocharged engine the available inlet air must be as nearly fully used for fuel combustion as possible. In this case we will want to make as many of the regions as possible at or near the chemically correct air-fuel vapor ratio. For this case to avoid overrichness we will want again to admit a larger proportion of the inlet air into the earlier parts of the droplet trajectory as fuel flow per engine revolution increases. Hence for maximum engine torque of a turbocharged engine an air-fuel proportioner can be used to sense fuel flow rate per engine revolution and to respond additionally by progressively opening the air inlet valves or dampers in the several separate air inlet channels so that the proportion of inlet air admitted to the earlier parts of the droplet trajectory is increased as fuel flow rate per engine revolution is increased. This function of the air-fuel proportioner for the turbocharged engine is the same as for the atmospherically aspirated engine and similar means can be used.

On turbocharged engines air-fuel proportioners can thus function to increase engine supercharge as fuel flow increases, or to admit air into earlier portions of the droplet trajectory as fuel flow increases, or to perform both of these functions at the same time or over different parts of the engine operating region. Which functions the air-fuel proportioner is to carry out will depend primarily on the application to which the engine is put.

When fuel flow per engine cycle is increased on a turbocharged engine more power is inevitably developed by the exhaust gas driven turbine even without controls and thus the turbine and supercharge compressor will speed up and supply more air to the engine without use of any air-fuel proportioner or other control. The exhaust turbine and air compressor are in effect "free-wheeling" on the attached engine. Hence we can design an engine-turbocharger-intake fuel fractionator and stratifier system which self regulates air flow in proper proportion to fuel flow without the need of an air-fuel proportioner control. Such an engine system would have improved mechanical simplicity.

Engines used in certain applications such as for motor transport may be required to utilize widely different fuels at different times. If these several fuels differ in vapor pressure properties the requirement for full evaporation may make it necessary to readjust the air flow distribution between the several separate air channels by readjustment of the flow restricting dampers therein. Alternatively the air temperatures in the several separate air channels may be readjusted as, for example, by adjusting the amount of unheated air, which bypasses the air heater element, going into one or more of the several separate air channels. It will be awkward to make these readjustments by hand each time a different fuel is used and an automatic scheme of readjustment is preferred. For example a liquid droplet sensor could be located in the droplet catcher region and an air-fuel vapor ratio sensor could be located within that separate air-fuel mixture channel which draws air-fuel vapor mixtures from the innermost radius of the vaporizer section. The droplet sensor could act via a suitable control device to increase air temperature supplied to the inner radius portion of the vaporizer whenever liquid droplets were reaching the droplet catcher and the consequent increased liquid evaporation at the inner radius would decrease the liquid quantity necessary to be evaporated at other portions of the droplet trajectory and hence would secure full evaporation. The air-fuel vapor ratio sensor could act via a suitable control device to decrease air temperature supplied to the inner radius portion of the vaporizer whenever the air-fuel vapor ratio became fuel richer than about chemically correct and the consequent decreased liquid evaporation at the inner radius would make fuel leaner the air-fuel vapor ratio created there and in this way over rich regions would be avoided. Instead of acting to control air temperatures as described above the droplet sensor and air-fuel vapor ratio sensors could alternatively act to change air flow distribution as between the inner radius and the outer radius of the vaporizer section. When liquid droplets reached the droplet sensor it could act to increase air flow into the outermost radius and thus to increase evaporation there. When over rich regions were sensed by the air-fuel vapor ratio sensor it could act to increase air flow into the innermost radius and thus to decrease overrichness there. Of course when more air is directed into the vaporizer at one radius air flow is necessarily decreased at other radii. For turbocharged engines the droplet sensor and air-fuel vapor ratio sensors and control device could act to increase turbocharger speed when either droplets or overrich regions were sensed and the consequently increased total air flow would increase evaporation and reduce overrichness. For this turbocharged engine application turbocharger speed would then be reduced whenever overlean regions were sensed. For a particular engine equipped with a particular engine intake fuel fractionator and stratifier device the fuel can certainly be created which at one and the same time will cause overrichness to occur at the inner radius of the vaporizer and liquid droplets to reach the droplet catcher and the droplet sensor and air-fuel vapor ratio sensor will then be acting simultaneously and at cross purposes. Within limits this situation can be accommodated by so designing the control devices that such simultaneous actuation of the droplet sensor and the air-fuel vapor ratio sensor would act to decrease fuel flow per engine revolution thus overriding the torque control lever. In lieu of thusly decreasing fuel flow per engine revolution the turbocharger speed on turbocharged engines could be increased and the consequently increased total air flow would simultaneously reduce overrichness and increase total evaporation.

Any means of sensing droplets or liquid in the droplet catcher region can be used for the droplet sensor. For example, any of the well known types of liquid detectors could be placed in the sump of the droplet catcher to detect when liquid was collecting there due to incomplete fuel evaporation. Such liquid level detectors would tend to be rather slow to respond to incomplete evaporation. Quicker response could be obtained from an electrically heated fine wire or screen located in the droplet catcher and measuring the wire temperature which will drop abruptly when struck by a liquid droplet.

Any means of sensing air-fuel vapor ratio in one or more of the separate air-fuel mixture channels can be used for the air-fuel vapor ratio sensor. For example, a fine screen resistor can be briefly heated with a pulse of electric currnet of fixed amperage and duration and the consequent temperature rise of the screen is then measured. The screen is in good thermal contact with the air-fuel vapor mixture and hence the screen temperature rise becomes less as the heat capacity of the air-fuel vapor mixture increases due to increasing fuel richness. In this way the air-fuel vapor ratio may be sensed. Water vapor also affects the heat capacity of air similarly to usual fuel hydrocarbons and a comparison technique may in some cases be preferred wherein the heat capacity of the air-fuel vapor mixture is compared to the heat capacity of an air only channel on the inlet side of the vaporizer.

The control devices are to respond to the signals from the droplet and air-fuel vapor ratio sensor by correcting the air flow distribution or by changing the air temperatures or by changing the turbocharger speed and devices suitable for these purposes are already well known in the art of control devices.

The sensors control scheme comprising droplet sensors, air-fuel vapor ratio sensors and control devices can be used alone or in combination with air-fuel proportioner linkages. A wide variety of combinations of sensors control schemes with air-fuel proportioner linkages are available and several of these may be preferable for particular engine applications. When used in combination with an air-fuel proportioner linkage the sensors control scheme can act to correct improper proportioner action caused by changes in fuel composition or other causes.

In the cross referenced related application adjustable stratifier valves are used and also regions containing only air, without fuel, could be put into the multiregional stratified air-fuel mixture at engine intake. Generally the number of such air only regions was to be decreased, by adjustment of the stratifier valve, as a means of increasing engine torque. For the invention described herein non-adjustable stratifier valves are used and air only regions are not used in the multiregional air-fuel mixture, since the number of such air only regions could not be decreased at higher torque with a non-adjustable stratifier valve. For the engine intake fuel fractionator and stratifier devices described herein engine torque is controlled in a simpler way by controlling the flow rate of a signle fuel into the vaporizer section. Hence both the stratifier valve and the torque control means are of simpler, less costly, design and this is one of the additional beneficial objects made available by use of the devices of this invention.

Nonetheless, air only regions can be used, if desired, in the multiregional stratified air-fuel mixture created at engine intake. This could be most simply accomplished by introducing an additional, air only, channel which bypassed the fractionator and connected to fixed ports of the stratifier valve. Use of such air only regions might be preferred, for example, in engine applications where the engine exhaust gas was to be fired to a waste heat boiler in which additional fuel, such as coal, was also to be burned and hence some unconsumed oxygen is desired in the engine exhaust.

Having thus described my invention, what I claim is:

1. The combination of an internal combustion engine, wherein the improvement comprises replacing the torque control and air-fuel mixing equipment of said internal combustion engine with apparatus comprising;

means for fractionally evaporating a moving multicomponent liquid fuel within an enclosed vaporizer section, whereby different fuel fractions evaporate at different positions along the motion paths of the moving liquid;

means for distributing the engine intake air flow into and out of said means for fractionally evaporating a moving liquid fuel, so that the air-fuel mixtures created by fractional evaporation of the moving liquid fuel into said engine intake air change along the length of the motion paths of the moving multicomponent liquid as to the fuel fractions present;

means for controlling the flow rate of liquid fuel into said means for fractionally evaporating said fuel, so that engine torque and power can be controlled;

means for making, during each engine intake process, a batch of separate connectings of the intake pipe of the engine into said means for fractionally evaporating a moving liquid fuel within an enclosed vaporizer section, said batch of connectings containing at least five differing connectings, said batch of connectings being at least one and preferably more than one full sequence of groups of connectings, each such group of connectings in said sequence of groups of connectings containing at least one connecting, the number of groups in each full sequence of groups of connectings shall be at least equal to the larger of the two values given by that integer next above the value of the numeral four divided by the number of connections which the connecting means make to the intake pipe of the engine, and the numeral two, each such group of connectings in said sequence of connectings differing from the preceding group of connectings so that, within the multiregional stratified air-fuel mixture thusly created in the intake pipe of the engine, any two adjacent air-fuel mixture regions therein come from differing connectings;

whereby a multiregional stratified air-fuel mixture is created in the intake pipe of said internal combustion engine wherein, when a single multicomponent fuel is supplied to said means for fractionally evaporating a moving fuel, differing regions within said multiregional stratified mixture contain different fuel fractions.

2. The combination of an internal combustion engine, wherein the improvement comprises replacing the torque control and air-fuel mixing equipment of said internal combustion engine with apparatus comprising;

means for fractionally evaporating a moving multicomponent liquid fuel within an enclosed vaporizer section, whereby different fuel fractions evaporate at different positions along the motion paths of the moving liquid;

means for disbributing the engine intake air flow into and out of said means for fractionally evaporating a moving liquid fuel, so that the air-fuel mixtures created by fractional evaporation of the moving liquid fuel into said engine intake air change along the length of the motion paths of the moving multicomponent liquid as to the fuel fractions present;

means for controlling the flow rate of liquid fuel into said means for fractionally evaporating said fuel, so that engine torque and power can be controlled;

means for making, during each engine intake process, a batch of separate connectings of the intake pipe of the engine into said means for fractionally evaporating a moving liquid fuel within an enclosed vaporizer section, said batch of connectings containing at least five differing connectings, said batch of connectings being at least one and preferably more than one full sequence of groups of connectings, each such group of connectings in said sequence of groups of connectings containing at least one connecting, the number of groups in each full sequence of groups of connectings shall be at least equal to the larger of the two values given by, that integer next above the value of the numeral four divided by the number of connections which the connecting means make to the intake pipe of the engine, and the numeral two, each of said differing connectings, within said batch of connectings, which is connected into the engine intake pipe for all groups of connectings in a full sequence of groups of connectings, shall make, at least once within said full sequence and the starting of the next full sequence, non-adjacent connectings into the engine intake manifold which occur one immediately after the other into two successive groups of connectings, said non-adjacent connectings being non-adjacent as between said two successive groups of connectings;

whereby a multiregional stratified air-fuel mixture is created in the intake pipe of said internal combustion engine wherein, when a single multicomponent fuel is supplied to said means for fractionally evaporating a moving fuel, differing regions within said multiregional stratified mixture contain different fuel fractions.

3. The combination of an internal combustion engine, wherein the improvement comprises replacing the torque control and air-fuel mixing equipment of said internal combustion engine with apparatus comprising;

means for fractionally evaporating a moving multicomponent liquid fuel within an enclosed vaporizer section, wherein said moving liquid fuel is spread into a large surface area broken through with air passages, whereby different fuel fractions evaporate at different positions along the motion paths of the moving liquid;

means for distributing the engine intake air flow into and out of said means for fractionally evaporating a moving liquid fuel, so that the air-fuel mixtures created by fractional evaporation of the moving liquid fuel into said engine intake air change along the length of the motion paths of the moving multicomponent liquid as to the fuel fractions present;

means for controlling the flow rate of liquid fuel into said means for fractionally evaporating said fuel, so that engine torque and power can be controlled;

means for collecting unevaporated liquid at the end of the liquid fuel motion paths and returning said collected liquid to the fuel tank;

means for making, during each engine intake process, a batch of separate connectings of the intake pipe of the engine into said means for fractionally evaporating a moving liquid fuel within an enclosed vaporizer section, said batch of connectings containing at least five differing connectings, said batch of connectings being a plurality of sequences of groups of connectings, each such group of connectings in said sequence of groups of connectings containing at least one connecting, each group of connectings in a full sequence of groups of connections which has adjacent connectings shall have at least one pair of differing adjacent connectings, the number of groups in each full sequence of groups of connectings shall be at least equal to the larger of the two values given by, that integer next above the value of the numeral four divided by the number of connections which the connecting means make to the intake pipe of the engine, and the numeral two, each of said differing connectings, within said batch of connectings, which is connected into the engine intake pipe for all groups of connectings in a full sequence of groups of connectings, shall make, at least once within said full sequence and the starting of the next full sequence, non-adjacent connectings into the engine intake manifold which occur one immediately after the other into two successive groups of connectings, said non-adjacent connectings being non-adjacent as between said two successive groups of connectings;

whereby a multiregional stratified air-fuel mixture is created in the intake pipe of said internal combustion engine wherein, when a single multicomponent fuel is supplied to said means for fractionally evaporating a moving fuel, differing regions within said multiregional stratified mixture contain different fuel fractions.

4. The combination of an internal combustion engine, wherein the improvement comprises replacing the torque control and air-fuel mixing equipment of said internal combustion engine with apparatus comprising:

means for fractionally evaporating a moving multicomponent liquid fuel within an enclosed vaporizer section, wherein said moving liquid fuel is spread into a large surface area broken through with air passages, wherein the liquid speeds are essentially equal at equal distances along the motion paths of said moving liquid fuel, whereby different fuel fractions evaporate at different positions along the motion paths of the moving liquid, essentially the same fuel fractions evaporating at all points an equal distance along the motion paths of said moving liquid fuel;

means for distributing the engine intake air into at least one separate air channel and increasing the temperature of the air flowing in at least one of said separate air channels;

means for distributing said engine intake air flow into and out of said means for fractionally evaporating a moving liquid fuel, with said engine intake air flow crossing through and between the moving liquid fuel motion paths, and also with the air crossing speeds being essentially equal at all points equidistant along the liquid fuel motion paths, so that the air-fuel mixtures created by fractional evaporation of the moving liquid fuel into said engine intake air change along the length of the motion paths of the moving multicomponent liquid as to the fuel fractions present, but are essentially the same as to the fuel fractions present and the mass ratio of air to fuel at equal distances along the motion paths of the moving liquid;

means for controlling the flow rate of liquid fuel into said means for fractionally evaporating said fuel, so that engine torque and power can be controlled;

means for collecting unevaporated liquid at the end of the liquid fuel motion paths and returning said collected liquid to the fuel tank;

means for making, during each engine intake process, a batch of separate connectings of the intake pipe of the engine into said means for fractionally evaporating a moving liquid fuel within an enclosed vaporizer section, said batch of connectings containing at least five differing connectings, said batch of connectings being a plurality of sequences of groups of connectings, each such group of connectings in said sequence of groups of connectings containing at least one connecting, each group of connectings in a full sequence of groups of connectings which has adjacent connectings shall have at least one pair of differing adjacent connectings, the number of groups in each full sequence of groups of connecting shall be at least equal to the larger of the two values given by, that integer next above the value of the numeral four divided by the number of connections which the connecting means make to the intake pipe of the engine, and the numeral two, each of said differing connectings, within said batch of connectings, which is connected into the engine intake pipe for all groups of connectings in a full sequence of groups of connectings, shall make, at least once within said full sequence and the starting of the next full sequence, non-adjacent connectings into the engine intake manifold which occur one immediately after the other into two successive groups of connectings, said non-adjacent connectings being non-adjacent as between said two successive groups of connectings;

whereby a multiregional stratified air-fuel mixture is created in the intake pipe of said internal combustion engine wherein, when a single multicomponent fuel is supplied to said means for fractionally evaporating a moving fuel, differing regions within said multiregional stratified mixture contain different fuel fractions.

5. The combination of an internal combustion engine, wherein the improvement comprises replacing the torque control and air-fuel mixing equipment of said internal combustion engine with apparatus comprising;

means for fractionally evaporating a moving multicomponent liquid fuel within an enclosed vaporizer section, wherein said moving liquid fuel is spread into a large surface area broken through with air passages, wherein the liquid speeds are essentially equal at equal distances along the motion paths of said moving liquid fuel, whereby different fuel fractions evaporate at different positions along the motion paths of the moving liquid, essentially the same fuel fractions evaporating at all points an equal distance along the motion paths of said moving liquid fuel;

means for distributing the engine intake air into at least one separate air channel and increasing the temperature of the air flowing in at least one of said separate air channels;

means for distributing said engine intake air flow into and out of said means for fractionally evaporating a moving liquid fuel, with said engine intake air flow crossing through and between the moving liquid fuel motion paths, and also with the air crossing speeds being essentially equal at all points equidistant along the liquid fuel motion paths, so that the air-fuel mixtures created by fractional evaporation of the moving liquid fuel into said engine intake air change along the length of the motion paths of the moving multicomponent liquid as to the fuel fractions present, but are essentially the same as to the fuel fractions present and the mass ratio of air to fuel at equal distances along the motion paths of the moving liquid;

means for controlling the flow rate of liquid fuel into said means for fractionally evaporating said fuel, so that engine torque and power can be controlled;

means for collecting unevaporated liquid at the end of the liquid fuel motion paths and returning said collected liquid to the fuel tank;

means for making, during each engine intake process, a batch of separate connectings of the intake pipe of the engine into said means for fractionally evaporating a moving liquid fuel within an enclosed vaporizer section, said batch of connectings containing at least five differing connectings, said batch of connectings being a plurality of sequences of groups of connectings, each group of connectings in a full sequence of groups of connectings which has adjacent connectings shall have at least one pair of differing adjacent connectings, the number of groups in each full sequence of groups of connectings shall be at least equal to the larger of the two values given by, that integer next above the value of the numeral four divided by the number of connections which the connecting means make to the intake pipe of the engine, and the numeral two, all such groups of connectings in said sequence of groups of connectings containing the same number of connectings equal to an integer multiplied by the number of differing connectings within said batch of connectings, each of said differing connectings, within said batch of connectings is connected into the engine intake pipe for all groups of connectings in a full sequence of groups of connectings, and shall make, at least once within said full sequence and the starting of the next full sequence, non-adjacent connectings into the engine intake manifold which occur one immediately after the other into two successive groups of connectings, said non-adjacent connectings being non-adjacent as between said two successive groups of connectings;

whereby the flow rate of air-fuel mixtures out of said means for fractionally evaporating a moving liquid fuel within an enclosed vaporizer section, is continuous at all positions along the motion paths of the moving liquid fuel except the ends, and has an essentially constant ratio at any two fixed positions along the motion paths of the moving liquid fuel, during each engine intake process;

whereby a multiregional stratified air-fuel mixture is created in the intake pipe of said internal combustion engine wherein, when a single multicomponent fuel is supplied to said means for fractionally evaporating a moving fuel, differing regions within said multiregional stratified mixture contain different fuel fractions.

6. The combination of an internal combustion engine, wherein the improvement comprises replacing the torque control and air-fuel mixing equipment of said internal combustion engine with apparatus comprising;

means for fractionally evaporating a moving multicomponent liquid fuel within an enclosed vaporizer section, wherein said moving liquid fuel is spread into a large surface area broken through with air passages, wherein the liquid speeds are essentailly equal at equal distances along the motion paths of said moving liquid fuel, whereby different fuel fractions evaporate at different positions along the motion paths of the moving liquid, essentially the same fuel fractions evaporating at all points an equal distance along the motion paths of said moving liquid fuel;

means for distributing the engine intake air into at least one separate air channel and increasing the temperature of the air flowing in at least one of said separate air channels;

means for distributing said engine intake air flow into and out of said means for fractionally evaporating a moving liquid fuel, with said engine intake air flow crossing through and between the moving liquid fuel motion paths, and also with the air crossing speeds being essentially equal at all points equidistant along the liquid fuel motion paths, so that the air-fuel mixtures created by fractional evaporation of the moving liquid fuel into said engine intake air change along the length of the motion paths of the moving multicomponent liquid as to the fuel fractions present, but are essentially the same as to the fuel fractions present and the mass ratio of air to fuel at equal distances along the motion paths of the moving liquid;

means for controlling the flow rate of liquid fuel into said means for fractionally evaporating said fuel, so that engine torque and power can be controlled;

means for collecting unevaporated liquid at the end of the liquid fuel motion paths and returning said collected liquid to the fuel tank;

means for making, during each engine intake process, a batch of separate connectings of the intake pipe of the engine into said means for fractionally evaporating a moving liquid fuel within an enclosed vaporizer section, said batch of connectings containing at least five differing connectings, said batch of connectings being a plurality of sequences of groups of connectings, each group of connectings in a full sequence of groups of connectings which has adjacent connectings shall have at least one pair of differing adjacent connectings, the number of groups in each full sequence of groups of connectings shall be at least equal to the larger of the two values given by, that integer next above the value of the numeral four divided by the number of connectings which the connecting means make to the intake pipe of the engine, and the numeral two, all such groups of connectings in said sequence of groups of connectings containing the same number of connectings equal to an integer multiplied by the number of differing connectings within said batch of connectings, each of said differing connectings, within said batch of connectings is connected into the engine intake pipe for all groups of connectings in a full sequence of groups of connectings, and shall make, at least once within said full sequence and the starting of the next full sequence, non-adjacent connectings into the engine intake manifold which occur one immediately after the other into two successive groups of connectings, said non-adjacent connectings being non-adjacent as between said two successive groups of connectings;

each such means for fractionally evaporating a moving liquid fuel into air being connected, via at least one of said means for making a batch of connectings during each engine intake process, to the intake pipes of a group of a plurality of engine cylinders whose number and relative cyclic timing creates a continuous flow of air-fuel mixture out of said each such means for fractionally evaporating a moving liquid fuel;

whereby the flow rate of air-fuel mixtures out of said means for fractionally evaporating a moving liquid fuel within an enclosed vaporizer section, is continuous at all positions along the motion paths of the moving liquid fuel except the ends, and has an essentially constant ratio at any two fixed positions along the motion paths of the moving liquid fuel, during each engine intake process;

whereby a multiregional stratified air-fuel mixture is created in the intake pipe of said internal combustion engine wherein, when a single multicomponent fuel is supplied to said means for fractionally evaporating a moving fuel, differing regions within said multiregional stratified mixture contain different fuel fractions.

7. The combination of an internal combustion engine, wherein the improvement comprises replacing the orque control and air-fuel mixing equipment of said nternal combustion engine with apparatus comprising:

means for fractionally evaporating a moving multicomponent liquid fuel within an enclosed vaporizer section, wherein said moving liquid fuel is spread into a large surface area broken through with air passages, wherein the liquid speeds are essentially equal at equal distances along the motion paths of said moving liquid fuel, whereby different fuel fractions evaporate at different positions along the motion paths of the moving liquid, essentially the same fuel fractions evaporating at all points an equal distance along the motion paths of said moving liquid fuel;

means for distributing the engine intake air into at least one separate air channel and increasing the temperature of the air flowing in at least one of said separate air channels;

means for distributing said engine intake air flow into and out of said means for fractionally evaporating a moving liquid fuel, with said engine intake air flow crossing through and between the moving liquid fuel motion paths, and also with the air crossing speeds being essentially equal at all points equidistant along the liquid fuel motion paths, so that the air-fuel mixtures created by fractional evaporation of the moving liquid fuel into said engine intake air change along the length of the motion paths of the moving multicomponent liquid as to the fuel fractions present, but are essentially the same as to the fuel fractions present and the mass ratio of air to fuel at equal distances along the motion paths of the moving liquid;

means for controlling the flow rate of liquid fuel into said means for fractionally evaporating said fuel, so that engine torque and power can be controlled;

means for collecting unevaporated liquid at the end of the liquid fuel motion paths and returning said collected liquid to the fuel tank;

means for making, during each engine intake process, a batch of separate connectings of the intake pipe of the engine into said means for fractionally evaporating a moving liquid fuel within an enclosed vaporizer section, said batch of connectings containing at least five differing connectings, said batch of connectings being a plurality of sequences of groups of connectings, the number of groups in each full sequence of groups of connectings shall be at least equal to the larger of the two values given by, that integer next above the value of the numeral four divided by the number of connections which the connecting means make to the intake pipe of the engine, and the numeral two, all such groups of connectings in said sequence of groups of connectings containing the same number of connectings equal to an integer multiplied by the number of differing connectings within said batch of connectings, all adjacent connectings in each group of connectings in a full sequence of groups of connectings shall differ, each of said differing connectings, within said batch of connectings is connected into the engine intake pipe for all groups of connectings in a full sequence of groups of connectings, and shall make, within said full sequence and the starting of the next full sequence, non-adjacent connectings into the engine intake manifold which occur one immediately after the other into all pairs of successive groups of connectings, said non-adjacent connectings being non-adjacent as between successive groups of connectings;

each such means for fractionally evaporating a moving liquid fuel into air being connected, via at least one of said means for making a batch of connectings during each engine intake process, to the intake pipes of a group of a plurality of engine cylinders whose number and relative cyclic timing creates a continuous flow of air-fuel mixture out of said each such means for fractionally evaporating a moving liquid fuel, whereby the flow rate of air-fuel mixtures out of said means for fractionally evaporating a moving liquid fuel within an enclosed vaporizer section, is continuous at all positions along the motion paths of the moving liquid fuel except the ends, and has an essentially constant ratio at any two fixed positions along the motion paths of the moving liquid fuel, during each engine intake process;

whereby a multiregional stratified air-fuel mixture is created in the intake pipe of said internal combustion engine wherein, when a single multicomponent fuel is supplied to said means for fractionally evaporating a moving fuel, differing regions within said multiregional stratified mixture contain different fuel fractions.

8. The combination of an internal combustion engine, wherein the improvement comprises replacing the torque control and air-fuel mixing equipment of said internal combustion engine with apparatus as recited in claim 3, and further comprising;

means for distributing the engine intake air into a plurality of separate air channels and increasing the temperature of the air flowing in at least one of said separate air channels;

means for adjusting the distribution of air flow between said separate air channels.

9. The combination of an internal combustion engine, wherein the improvement comprises replacing the torque control and air-fuel mixing equipment of said internal combustion engine with apparatus as recited in claim 7;

wherein a plurality of separate air channels are used with said means for distributing the engine intake air into at least one separate air channel;

and further comprising;

means for adjusting the distribution of air flow between said separate air channels.

10. The combination of an internal combustion engine, wherein the improvement comprises replacing the torque control and air-fuel mixing equipment of said internal combustion engine with apparatus as recited in claim 3;

and further comprising;

means for distributing the engine intake air into at least one separate air channel and increasing the temperature of the air flowing in at least one of said separate air channels;

means for adjusting the temperature of the air flowing in at least one of said separate air channels.

11. The combination of an internal combustion engine, wherein the improvement comprises replacing the torque control and air-fuel mixing equipment of said internal combustion engine with apparatus as recited in claim 7;

and further comprising;

means for adjusting the temperature of the air flowing in at least one of said separate air channels.

12. The combination of an internal combustion engine, wherein the improvement comprises replacing the torque control and air-fuel mixing equipment of said internal combustion engine with apparatus as recited in claim 3;

and further comprising;

means for distributing the engine intake air into a plurality of separate air channels and increasing the temperature of the air flowing in at least one of said separate air channels;

means for adjusting the temperature of the air flowing in at least one of said separate air channels;

means for adjusting the distribution of air flow between said separate air channels.

13. The combination of an internal combustion engine, wherein the improvement comprises replacing the torque control and air-fuel mixing equipment of said internal combustion engine with apparatus as recited in claim 7;

wherein a plurality of separate air channels are used with said means for distributing the engine intake air into at least one separate air channel;

and further comprising;

means for adjusting the temperature of the air flowing in at least one of said separate air channels;

means for adjusting the distribution of the air flow between said separate air channels.

14. The combination of an internal combustion engine, wherein the improvement comprises replacing the torque control and air-fuel mixing equipment of said internal combustion engine with apparatus as recited in claim 8;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proportion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

whereby fuel vapor overrichness is prevented in those air fuel vapor mixtures formed at said early portions of the motion paths of the moving liquid when the engine is fully warmed up.

15. The combination of an internal combustion engine, wherein the improvement comprises replacing the torque control and air fuel mixing equipment of said internal combustion engine with apparatus as recited in claim 9;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proprotion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

whereby fuel vapor overrichness is prevented in those air-fuel vapor mixtures formed at said early portions of the motion paths of the moving liquid when the engine is fully warmed up.

16. The combination of an internal combustion engine, wherein the improvement comprises replacing the torque control and air-fuel mixing equipment of said internal combustion engine with apparatus as recited in claim 10;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the temperature of the air flowing in at least one of the separate air channels, so that as fuel flow rate per engine revolution increases said air temperature is increased in at least that separate air channel which directs air flow to the last portions of the motion paths of the moving liquid, and so that as fuel flow rate per engine revolution decreases said air temperature is decreased in at least that separate air channel which directs air flow to the last portions of the motion paths of the moving liquid;

whereby all liquid fuel flowing into the fractionator is fully evaporated prior to the ends of the motion paths of the moving liquid when the engine is fully warmed up.

17. The combination of an internal combustion engine, wherein the improvement comprises replacing the torque control and air-fuel mixing equipment of said internal combustion engine with apparatus as recited in claim 11;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the temperature of the air flowing in at least one of the separate air channels, so that as fuel flow rate per engine revolution increases said air temperature is increased in at least that separate air channel which directs air flow to the last portions of the motion paths of the moving liquid, and so that as fuel flow rate per engine revolution decreases said air temperature is decreased in at least that separate air channel which directs air flow to the last portions of the motion paths of the moving liquid;

whereby all liquid fuel flowing into the fractionator is fully evaporated prior to the ends of the motion paths of the moving liquid when the engine is fully warmed up.

18. The combination of an internal combustion engine, wherein the improvement comprises replacing the torque control and air-fuel mixing equipment of said internal combustion engine with apparatus as recited in claim 12;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proportion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

means for linking said means for controlling the flow rate of liquid fuel per engine revolution into the fractionator with said means for adjusting the temperature of the air flowing in at least one of the separate air channels, so that as fuel flow rate per engine revolution increases said air temperature is increased in at least that separate air channel which directs air flow to the last portions of the motion paths of the moving liquid, and so that as fuel flow rate per engine revolution decreases said air temperature is decreased in at least that separate air channel which directs air flow to the last portions of the motion paths of the moving liquid;

whereby all liquid fuel flowing into the fractionator is fully evaporated prior to the ends of the motion paths of the moving liquid and fuel vapor overrichness is prevented in the air fuel vapor mixtures formed at all portions of the motion paths of the moving liquid when the engine is fully warmed up.

19. The combination of an internal combustion engine, wherein the improvement comprises replacing the torque control and air-fuel mixing equipment of said internal combustion engine with apparatus as recited in claim 13;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proportion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

means for linking said means for controlling the flow rate of liquid fuel per engine revolution into the fractionator with said means for adjusting the temperature of the air flowing in at least one of the separate air channels, so that as fuel flow rate per engine revolution increases said air temperature is increased in at least that separate air channel which directs air flow to the last portions of the motion paths of the moving liquid, and so that as fuel flow rate per engine revolution decreases said air temperature is decreased in at least that separate air channel which directs air flow to the last portions of the motion paths of the moving liquid;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

20. The combination of an internal combustion engine, wherein the improvement comprises replacing the torque control and air-fuel mixing equipment of said internal combustion engine with apparatus as recited in claim 3;

and further comprising;

means for distributing the engine intake air into at least one separate air channel and increasing the temperature of the air flowing in at least one of said separate air channels;

means for linking said means for controlling the flow rate of liquid fuel into the fractionator with the controls of the engine turbocharger, so that as fuel flow rate increases the speed of the turbocharger is increased, and so that as fuel flow rate decreases the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

21. The combination of an internal combustion engine, wherein the improvement comprises replacing the torque control and air-fuel mixing equipment of said internal combustion engine with apparatus as recited in claim 7;

and further comprising;

means for linking said means for controlling the flow rate of liquid fuel into the fractionator with the controls of the engine turbocharger, so that as fuel flow rate increases the speed of the turbocharger is increased, and so that as fuel flow rate decreases the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

22. The combination of an internal combustion engine, wherein the improvement comprises replacing the torque control and air-fuel mixing equipment of said internal combustion engine with apparatus as recited in claim 8;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proportion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

means for linking said means for controlling the flow rate of liquid fuel into the fractionator with the controls of the engine turbocharger, so that as fuel flow rate increases the speed of the turbocharger is increased, and so that as fuel flow rate decreases the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

23. The combination of an internal combustion engine, wherein the improvement comprises replacing the torque control and air-fuel mixing equipment of said internal combustion engine with apparatus as recited in claim 9;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proportion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

means for linking said means for controlling the flow rate of liquid fuel into the fractionator with the controls of the engine turbocharger, so that as fuel flow rate increases the speed of the turbocharger is increased, and so that as fuel flow rate decreases the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

24. The combination of an internal combustion engine, wherein the improvement comprises replacing the torque control and air-fuel mixing equipment of said internal combustion engine with apparatus as recited in claim 12;

wherein said means for controlling the flow rate of liquid fule into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proportion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

means for linking said means for controlling the flow rate of liquid fuel per engine revolution into the fractionator with said means for adjusting the temperature of the air flowing in at least one of the separate air channels, so that as fuel flow rate per engine revolution increases said air temperature is increased in at least that separate air channel which directs air flow to the last portions of the motion paths of the moving liquid, and so that as fuel flow rate per engine revolution decreases said air temperature is decreased in at least that separate air channel which directs air flow to the last portions of the motion paths of the moving liquid;

means for linking said means for controlling the flow rate of liquid fuel into the fractionator with the controls of the engine turbocharger, so that as fuel flow rate increases the speed of the turbocharger is increased, and so that as fuel flow rate decreases the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

25. The combination of an internal combustion engine, wherein the improvement comprises replacing the orque control and air-fuel mixing equipment of said nternal combustion engine with apparatus as recited in claim 13;

wherein said means for controlling the flow rate of liquid fuel into the fractionators controls said flow rate per engine revolution;

and further comprising;

means for linking said means for controlling the flow rate of liquid fuel per engine revolution into the fractionator with said means for adjusting the distribution of air flow between said separate air channels, so that as fuel flow rate per engine revolution increases a larger proportion of the air flow is directed into those separate air channels which direct said air flow to the early portions of the motion paths of the moving liquid, and so that as fuel flow rate per engine revolution decreases a smaller proportion of the air flow is directed into those separate air channels which direct said air flow to the early portions of the motion paths of the moving liquid;

means for linking said means for controlling the flow rate of liquid fuel per engine revolution into the fractionator with said means for adjusting the temperature of the air flowing in at least one of the separate air channels, so that as fuel flow rate per engine revolution increases said air temperature is increased in at least that separate air channel which directs air flow to the last portions of the motion paths of the moving liquid, and so that as fuel flow rate per engine revolution decreases said air temperature is decreased in at least that separate air channel which directs air flow to the last portions of the motion paths of the moving liquid;

means for linking said means for controlling the flow rate of liquid fuel into the fractionator with the controls of the engine turbocharger so that as fuel flow rate increases the speed of the turbocharger is increased, and so that as fuel flow rate decreases the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

26. The combination of an internal combustion engine, wherein the improvement comprises replacing the torque control and air-fuel mixing equipment of said internal combustion engine with apparatus as recited in claim 8;

and further comprising;

means for sensing the presence of unevaporated liquid in said means for collecting unevaporated liquid at the end of the liquid fuel motion paths;

means for sensing the presence of overrich air-fuel vapor mixtures richer in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the distribution of air flow between said separate air channels, so that when unevaporated liquid is sensed and the engine is warmed up a larger proportion of the air flow is directed into that separate air channel which directs air to the last portions of the liquid fuel motion paths, and so that when overrich mixtures are sensed a larger proportion of the air flow is directed into that separate air channel which directs air to the first portions of the liquid fuel motion paths;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

27. The combination of an internal combustion engine, wherein the improvement comprises replacing the torque control and air-fuel mixing equipment of said internal combustion engine with apparatus as recited in claim 8; pl and further comprising;

means for sensing the presence of unevaporated liquid in said means for collecting unevaporated liquid at the end of the liquid fuel motion paths;

means for sensing the presence of overrich air-fuel vapor mixtures richer in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the distribution of air flow between said separate air channels, and also with said means for controlling the flow rate of liquid fuel into the fractionator, so that when unevaporated liquid is sensed and the engine is warmed up a larger proportion of the air flow is directed into that separate air channel which directs air to the last portions of the liquid fuel motion paths, and so that when overrich mixtures are sensed a larger proportion of the air flow is directed into that separate air channel which directs air to the first portions of the liquid fuel motion paths, and further so that when both unevaporated liquid and overrich mixtures are simultaneously sensed the liquid fuel flow rate into the fractionator is reduced;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

28. The combination of an internal combustion engine, wherein the improvement comprises replacing the torque control and air-fuel mixing equipment of said internal commbustion engine with apparatus as recited in claim 9;

and further comprising;

means for sensing the presence of unevaporated liquid in said means for collecting unevaporated liquid at the end of the liquid fuel motion paths;

means for sensing the presence of overrich air-fuel vapor mixtures richer in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the distribution of air flow between said separate air channels, and also with said means for controlling the flow rate of liquid fuel into the fractionator, so that when unevaporated liquid is sensed and the engine is warmed up a larger proportion of the air flow is directed into that separate air channel which directs air to the last portions of the liquid fuel motion paths, and so that when overrich mixtures are sensed a larger proportion of the air flow is directed into that separate air channel which directs air to the first portions of the liquid fuel motion paths, and further so that when both unevaporated liquid and overrich mixtures are simultaneously sensed the liquid fuel flow rate into the fractionator is reduced;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

29. The combination of an internal combustion engine, wherein the improvement comprises replacing the torque control and air-fuel mixing equipment of said internal combustion engine with apparatus as recited in claim 10;

and further comprising;

means for sensing the presence of unevaporated liquid in said means for collecting unevaporated liquid at the end of the liquid fuel motion paths;

means for sensing the presence of overrich air-fuel vapor mixtures richer in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the temperature of the air flowing in at least one of said separate air channels, so that when unevaporated liquid is sensed and the engine is warmed up the temperature of the air flowing in that separate air channel which directs air to the first portions of the liquid fuel motion paths is increased, and so that when overrich mixtures are sensed the temperature of the air flowing in that separate air channel which directs air to the first portions of the liquid fuel motion paths is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

30. The combination of an internal combustion engine, wherein the improvement comprises replacing the torque control and air-fuel mixing equipment of said internal combustion engine with apparatus as recited in claim 10;

and further comprising;

means for sensing the presence of unevaporated liquid in said means for collecting unevaporated liquid at the end of the liquid fuel motion paths;

means for sensing the presence of overrich air-fuel vapor mixtures richer in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the temperature of the air flowing in at least one of said separate air channels, and also with said means for controlling the flow rate of liquid fuel into the fractionator, so that when unevaporated liquid is sensed and the engine is warmed up the temperature of the air flowing in that separate air channel which directs air to the first portions of the liquid fuel motion paths is increased, and so that when overrich mixtures are sensed the temperature of the air flowing in that separate air channel which directs air to the first portions of the liquid fuel motion paths is decreased, and further so that when both unevaporated liquid and overrich mixtures are simultaneously sensed the liquid fuel flow rate into the fractionator is reduced;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

31. The combination of an internal combustion engine, wherein the improvement comprises replacing the torque control and air-fuel mixing equipment of said internal combustion engine with apparatus as recited in claim 11;

and further comprising;

means for sensing the presence of unevaporated liquid in said means for collecting unevaporated liquid at the end of the liquid fuel motion paths;

means for sensing the presence of overrich air-fuel vapor mixtures richer in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the temperature of the air flowing in at least one of said separate air channels, and also with said means for controlling the flow rate of liquid fuel into the fractionator, so that when unevaporated liquid is sensed and the engine is warmed up the temperature of the air flowing in that separate air channel which directs air to the first portions of the liquid fuel motion paths is increased, and so that when overrich mixtures are sensed the temperature of the air flowing in that separate air channel which directs air to the first portions of the liquid fuel motion paths is decreased, and further so that when both unevaporated liquid and overrich mixtures are simultaneously sensed the liquid fuel flow rate into the fractionator is reudced;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

32. The combination of an internal combustion engine, wherein the improvement comprises replacing the torque control and air-fuel mixing equipment of said internal combustion engine with apparatus as recited in claim 3;

and further comprising;

means for distributing the engine intake air into at least one separate air channel and increasing the temperature of the air flowing in at least one of said separate air channels;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with the controls of the engine turbocharger, so that when unevaporated liquid is sensed and the engine is warmed up, the speed of the turbocharger is increased, and also so that when overrich mixtures are sensed the speed of the turbocharger is increased, and also so that when overlean mixtures are sensed the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

33. The combination of an internal combustion engine, wherein the improvement comprises replacing the torque control and air-fuel mixing equipment of said internal combustion engine with apparatus as recited in claim 8;

and further comprising;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the distribution of air flow between said separate air channels, and also with the controls of the engine turbocharger, so that when unevaporated liquid is sensed and the engine is warmed up a larger proportion of the air flow is directed into that separate air channel which directs air to the last portions of the liquid fuel motion paths, and so that when overrich mixtures are sensed a larger proportion of the air flow is directed into that separate air channel which directs air to the first portions of the liquid fuel motion paths, and further so that when unevaporated liquid and overrich mixtures are simultaneously sensed the speed of the turbocharger is increased, and also so that when overlean mixtures are sensed the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

34. The combination of an internal combustion engine, wherein the improvement comprises replacing the torque control and air-fuel mixing equipment of said internal combustion engine with apparatus as recited in claim 9;

and further comprising;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the distribution of air flow between said separate air channels, and also with the controls of the engine turbocharger, so that when unevaporated liquid is sensed and the engine is warmed up a larger proportion of the air flow is directed into that separate air channel which directs air to the last portions of the liquid fuel motion paths, and so that when overrich mixtures are sensed a larger proportion of the air flow is directed into that separate air channel which directs air to the first portions of the liquid fuel motion paths, and further so that when unevaporated liquid and overrich mixtures are simultaneously sensed the speed of the turbocharger is increased, and also so that when overlean mixtures are sensed the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

35. The combination of an internal combustion engine, wherein the improvement comprises replacing the torque control and air-fuel mixing equipment of said internal combustion engine with apparatus as recited in claim 10;

and further comprising;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the temperature of the air flowing in at least one of said separate air channels, and also with the controls of the engine turbocharger, so that when unevaporated liquid is sensed and the engine is warmed up the temperature of the air flowing in that separate air channel which directs air to the first portions of the liquid fuel motion paths is increased, and so that when overrich mixtures are sensed the temperature of the air flowing in that separate air channel which directs air to the first portions of the liquid fuel motion paths is decreased, and further so that when unevaporated liquid and overrich mixtures are simultaneously sensed the speed of the turbocharger is increased, and also so that when overlean mixtures are sensed the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

36. The combination of an internal combustion engine, wherein the improvement comprises replacing the torque control and air-fuel mixing equipment of said internal combustion engine with apparatus as recited in claim 11;

and further comprising;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the temperature of the air flowing in at least one of said separate air channels, and also with the controls of the engine turbocharger, so that when unevaporated liquid is sensed and the engine is warmed up the temperature of the air flowing in that separate air channel which directs air to the first portions of the liquid fuel motion paths is increased, and so that when overrich mixtures are sensed the temperature of the air flowing in that separate air channel which directs air to the first portions of the liquid fuel motion paths is decreased, and further so that when unevaporated liquid and overrich mixtures are simultaneously sensed the speed of the turbocharger is increased, and also so that when overlean mixtures are sensed the speed of the turbocharger is decreased;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

37. The combination of an internal combustion engine, wherein the improvement comprises replacing the torque control and air-fuel mixing equipment of said internal combustion engine with apparatus as recited in claim 14;

and further comprising;

means for sensing the presence of unevaporated liquid in said means for collecting unevaporated liquid at the end of the liquid fuel motion paths;

means for sensing the presence of overrich air-fuel vapor mixtures richer in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the distribution of air flow between said separate air channels, and also with said means for controlling the flow rate of liquid fuel into the fractionator, so that when unevaporated liquid is sensed and the engine is warmed up a larger proportion of the air flow is directed into that separate air channel which directs air to the last portions of the liquid fuel motion paths, and so that when overrich mixtures are sensed a larger proportion of the air flow is directed into that separate air channel which directs air to the first portions of the liquid fuel motion paths, and further so that when both unevaporated liquid and overrich mixtures are simultaneously sensed the liquid fuel flow rate into the fractionator is reduced;

whereby all liquid fuel flowing into the fractionator is fully evaporated prior to the ends of the motion paths of the moving liquid and fuel vapor overrichness is prevented in the air-fuel vapor mixtures formed at all portions of the motion paths of the moving liquid when the engine is fully warmed up.

38. The combination of an internal combustion engine, wherein the improvement comprises replacing the torque control and air-fuel mixing equipment of said internal combustion engine with apparatus as recited in claim 20;

and further comprising;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with the controls of the engine turbocharger, so that when unevaporated liquid is sensed and the engine is warmed up, the speed of the turbocharger is increased, and also so that when overrich mixtures are sensed the speed of the turbocharger is increased, and also so that when overlean mixtures are sensed the speed of the turbocharger is decreased.

39. The combination of an internal combustion engine, wherein the improvement comprises replacing the torque control and air-fuel mixing equipment of said internal combustion engine with apparatus as recited in claim 21;

and further comprising;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with the controls of the engine turbocharger, so that when unevaporated liquid is sensed and the engine is warmed up the speed of the turbocharger is increased, and also so that when overrich mixtures are sensed the speed of the turbocharger is increased, and also so that when overlean mixtures are sensed the speed of the turbocharger is decreased.

40. The combination of an internal combustion engine, wherein the improvement comprises replacing the torque control and air-fuel mixing equipment of said internal combustion engine with apparatus as recited in claim 20;

wherein a plurality of separate air channels are used with said means for distributing the engine intake air into at least one separate air channel;

and further comprising;

means for adjusting the distribution of air flow between said separate air channels;

means for sensing the presence of unevaporated liquid in said means for collecting unevaporated liquid at the end of the liquid fuel motion paths;

means for sensing the presence of air-fuel vapor mixtures richer in fuel and leaner in fuel than about the chemically correct air-fuel ratio in the first portions of the liquid fuel motion paths;

means for sensing a temperature of the engine cylinder cooling system;

means for controllably coupling said means for sensing the presence of unevaporated liquid and said means for sensing the presence of overrich air-fuel vapor mixtures and said means for sensing a temperature of the engine cylinder cooling system with said means for adjusting the distribution of air flow between said separate air channels, and also with the controls of the engine turbocharger, so that when unevaporated liquid is sensed and the engine is warmed up a larger proportion of the air flow is directed into that separate air channel which directs air to the last portions of the liquid fuel motion paths, and so that when overrich mixtures are sensed a larger proportion of the air flow is directed into that separate air channel which directs air to the first portions of the liquid fuel motion paths, and further so that when unevaporated liquid and overrich mixtures are simultaneously sensed the speed of the turbocharger is increased, and also so that when overlean mixtures are sensed the speed of the turbocharger is decreased;

whereby all liquid fuel flowing into the fractionator is fully evapoated prior to the ends of the motion paths of the moving liquid and fuel vapor overrichness is prevented in the air-fuel vapor mixtures formed at all portions of the motion paths of the moving liquid when the engine is fully warmed up.

41. The combination of an internal combustion engine, wherein the improvement comprises replacing the torque control and air-fuel mixing equipment of said internal combustion engine with apparatus as recited in claim 3;

wherein said means for distributing said engine intake air flow into and out of said fractionator also distributes some portion of the air flow into a separate bypass channel which bypasses the fractionator, said separate bypass channel being also connected to by said means for making a batch of separate connectings of the intake pipe of the engine;

and further comprising;

means for distributing the engine intake air into a plurality of separate air channels and increasing the temperature of the air flowing in at least one of said separate air channels;

whereby the multiregional stratified air-fuel mixture created in the engine intake pipe will contain some regions of air only.

42. The combination of an internal combustion engine, wherein the improvement comprises replacing the torque control and air-fuel mixing equipment of said internal combustion engine with apparatus as recited in claim 7;

wherein a plurality of separate air channels are used with said means for distributing the engine intake air into at least one separate air channel;

wherein said means for distributing said engine intake air flow into and out of said fractionator also distributes some portion of the air flow into a separate bypass channel which bypasses the fractionator, said separate bypass channel being also connected to by said means for making batch of separate connectings of the intake pipe of the engine;

whereby the multiregional stratified air-fuel mixture created in the engine intake pipe will contain some regions of air only.

* * * * *

UNITED STATES PATENT AND TRADEMARK OFFICE

CERTIFICATE OF CORRECTION

PATENT NO. : 4,205,647

DATED : June 3, 1980

INVENTOR(S) : Joseph C. Firey

It is certified that error appears in the above—identified patent and that said Letters Patent is hereby corrected as shown below:

The attached columns 9-12 should be inserted as part of the above-identified patent.

Signed and Sealed this

*Ninth* Day of *September 1980*

[SEAL]

*Attest:*

SIDNEY A. DIAMOND

*Attesting Officer*

*Commissioner of Patents and Trademarks*